US012768079B2

(12) United States Patent
Man et al.

(10) Patent No.: US 12,768,079 B2
(45) Date of Patent: Oct. 20, 2026

(54) SPINNING-DRAWING-WINDING DEVICE AND COMBINED MACHINE FOR INDUSTRIAL BIO-BASED POLYAMIDE

(71) Applicant: BEIJING CHONGLEE MACHINERY ENGINEERING CO., LTD., Beijing (CN)

(72) Inventors: Xiaodong Man, Beijing (CN); Junxian Qiu, Beijing (CN); Yubo Mao, Beijing (CN); Kai Xu, Beijing (CN); Yadi Li, Beijing (CN); Yuguo Ren, Beijing (CN); Bo Hou, Beijing (CN); Yan Wu, Beijing (CN); Yu Dong, Beijing (CN); Xue Bai, Beijing (CN); Peng Liu, Beijing (CN); Jing Zhang, Beijing (CN)

(73) Assignee: BEIJING CHONGLEE MACHINERY ENGINEERING CO., LTD., Beijing (CN)

( * ) Notice: Subject to any disclaimer, the term of this patent is extended or adjusted under 35 U.S.C. 154(b) by 168 days.

(21) Appl. No.: 18/605,769

(22) Filed: Mar. 14, 2024

(65) Prior Publication Data

US 2024/0263356 A1 Aug. 8, 2024

Related U.S. Application Data

(63) Continuation of application No. PCT/CN2022/123182, filed on Sep. 30, 2022.

(30) Foreign Application Priority Data

Sep. 17, 2021 (CN) ..... 202111090536.3
Sep. 17, 2021 (CN) ..... 202111090662.9
(Continued)

(51) Int. Cl.
*D01D 5/088* (2006.01)
*D01D 5/084* (2006.01)
(Continued)

(52) U.S. Cl.
CPC ..... *D01D 5/088* (2013.01); *D01D 5/084* (2013.01); *D01D 5/16* (2013.01); *D01D 10/02* (2013.01);
(Continued)

(58) Field of Classification Search
CPC .... D01D 5/088; D01D 5/084; D01D 10/0436; D01D 5/08; D01D 10/04
See application file for complete search history.

(56) References Cited

U.S. PATENT DOCUMENTS 5,066,439 A * 11/1991 Nishikawa ..... D01F 6/62 264/211.17
10,370,780 B2 * 8/2019 Keulers ..... D01D 5/16
(Continued)

FOREIGN PATENT DOCUMENTS

CN 1117186 C * 8/2003 ..... D01D 5/092
CN 107034533 A 8/2017
(Continued)

OTHER PUBLICATIONS

Translation of CN1117186C (Year: 2025).*
(Continued)

*Primary Examiner* — Emmanuel S Luk
(74) *Attorney, Agent, or Firm* — Syncoda LLC; Feng Ma

(57) ABSTRACT

In a spinning-drawing-winding device and a combined machine for industrial bio-based polyamide, according to a traveling direction of a tow, two adjacent rotational directions among a rotational direction of the tow winding through the first pair of drawing hot rollers, a rotational direction of the tow winding through the second pair of
(Continued)

drawing hot rollers, a rotational direction of the tow winding through the third pair of drawing hot rollers, a rotational direction of the tow winding through the fourth pair of drawing hot rollers are in opposite to spin an industrial bio-based polyamide filament of 55 dtex-2222 dtex.

19 Claims, 17 Drawing Sheets

(30) Foreign Application Priority Data

Sep. 17, 2021 (CN) ..... 202122263998.2
Sep. 17, 2021 (CN) ..... 202122277932.9

(51) Int. Cl.
*D01D 5/16* (2006.01)
*D01D 10/02* (2006.01)
*D01D 10/04* (2006.01)

(52) U.S. Cl.
CPC ..... *D01D 10/0436* (2013.01); *D10B 2331/02* (2013.01)

(56) References Cited

U.S. PATENT DOCUMENTS 11,554,746 B2 * 1/2023 Hill ..... D06N 3/0006
2003/0236554 A1 * 12/2003 Chen ..... B29C 48/875 606/228
2011/0175249 A1 * 7/2011 Yamamoto ..... B41N 1/247 264/211.17
2011/0287676 A1 * 11/2011 Ichikawa ..... D01D 7/00 442/1
2013/0264733 A1 * 10/2013 Ichikawa ..... D01D 5/16 264/210.8
2014/0302263 A1 * 10/2014 Ise ..... D01F 6/60 428/401
2020/0216980 A1 * 7/2020 Lim ..... D01F 6/62
2020/0332442 A1 * 10/2020 Schrempf ..... B29C 48/919
2021/0040650 A1 * 2/2021 Yoshioka ..... D01D 5/098

FOREIGN PATENT DOCUMENTS

CN 107904685 A 4/2018
CN 108441975 A 8/2018
CN 108642583 A 10/2018
EP 1022364 A1 * 7/2000 ..... D02G 1/12

OTHER PUBLICATIONS

International Search Report prepared by the State Intellectual Property Office of the P.R. China for PCT/CN2022/123182, Dec. 28, 2022, 4 pages.
Written Opinion prepared by the State Intellectual Property Office of the P.R. China for PCT/CN2022/123182, Dec. 28, 2022, 5 pages.

* cited by examiner

A-A

SPINNING-DRAWING-WINDING DEVICE AND COMBINED MACHINE FOR INDUSTRIAL BIO-BASED POLYAMIDE

CROSS-REFERENCE TO RELATED APPLICATIONS

This is a continuation of International Application No. PCT/CN2022/123182 field on Sep. 30 2022, which claims priority to Chinese patent application Ser. No. 20/211,1090662.9 filed on Sep. 17, 2021, Chinese patent application Ser. No. 20/212,2263998.2 filed on Sep. 17, 2021, Chinese patent application Ser. No. 20/211,1090536.3 filed on Sep. 17, 2021, and Chinese patent application Ser. No. 20/212,2277932.9 filed on Sep. 17, 2021. The disclosures of the above-referenced applications are hereby incorporated by reference in their entirety.

BACKGROUND

Currently, almost all polyamides on the market are produced by petrochemical methods. If the petrochemical methods are replaced with biological methods, the polyamide industry will become a sustainable development industry, and the demand for bio-based polyamide fibers will increase significantly.

The bio-based polyamide fibers have the same excellent physical properties as ordinary polyamide. A fine denier bio-based polyamide fiber of 55 dtex-111 dtex is used in medical treatment. A coarse denier bio-based polyamide fiber of 1670 dtex-2222 dtex has broad applications in industries of decoration, tire cord fabric, cable ropes, conveyor belts, automotive textiles, filter materials and so on. However, in related technologies, a bio-based polyamide fibers of 555 dtex-1670 dtex are mostly spun, and the fine denier and coarse denier bio-based polyamide fibers are sparely spun.

SUMMARY

The disclosure relates to the technical field of production and manufacturing of yarn, and in particular to a spinning-drawing-winding device for industrial bio-based polyamide, and a combined spinning-drawing and winding machine for industrial bio-based polyamide.

Based on the above problems, the disclosure provides a spinning-drawing-winding device and a combined machine for industrial bio-based polyamide.

In an aspect of the disclosure, a spinning-drawing-winding device for industrial bio-based polyamide is provided. The device sequentially includes, along a traveling direction of a tow: a feeding-splitting filament tension roller, a first pair of drawing hot rollers, a second pair of drawing hot rollers, a third pair of drawing hot rollers, a fourth pair of drawing hot rollers and a fifth pair of drawing hot rollers; two adjacent rotational directions among a rotational direction of the tow winding through the first pair of drawing hot rollers, a rotational direction of the tow winding through the second pair of drawing hot rollers, a rotational direction of the tow winding through the third pair of drawing hot rollers, a rotational direction of the tow winding through the fourth pair of drawing hot rollers are opposite to spin an industrial bio-based polyamide filament of 55 dtex-2222 dtex.

In another aspect of the disclosure, a spinning-drawing-winding combined machine for industrial bio-based polyamide, which include the following disposed in sequence according to a production process: a screw extruder, a melt pipe, a spinning box, a metering pump, a spinning assembly, a heat-retarder, a monomer suction mechanism, a side blowing component, a spinning channel component, a double-surface oiling mechanism, a pre-interlacer, a filament guider, a feeding-splitting filament tension roller, a first heating plate, a first pair of drawing hot rollers, a second heating plate, a second pair of drawing hot rollers, a third heating plate, a third pair of drawing hot rollers, a fourth heating plate, a fourth pair of drawing hot rollers, a fifth heating plate, a fifth pair of drawing hot rollers, a final interlacer and a fully automatic winding head; the first heating plate, the second heating plate, the third heating plate, the fourth heating plate and the fifth heating plate each heat the tow in areas between two adjacent rollers; two adjacent rotational directions among a rotational direction of the tow winding through the first pair of drawing hot rollers, a rotational direction of the tow winding through the second pair of drawing hot rollers, a rotational direction of the tow winding through the third pair of drawing hot rollers, a rotational direction of the tow winding through the fourth pair of drawing hot rollers are in opposite to spin an industrial bio-based polyamide filament of 55 dtex-2222 dtex.

The disclosure provides a spinning-drawing-winding device for industrial bio-based polyamide, which sequentially includes, along a traveling direction of a tow: a feeding-splitting filament tension roller, a first pair of drawing hot rollers, a second pair of drawing hot rollers, a third pair of drawing hot rollers, a fourth pair of drawing hot rollers and a fifth pair of drawing hot rollers; and a rotational direction of the tow winding through the first pair of drawing hot rollers and a rotational direction of the tow winding through the second pair of drawing hot rollers are set in opposite, and the rotational direction of the tow winding through the second pair of drawing hot rollers and a rotational direction of the tow winding through the third pair of drawing hot rollers are set in opposite, and the rotational direction of the tow winding through the third pair of drawing hot rollers and a rotational direction of the tow winding through the fourth pair of drawing hot rollers are set in opposite. Therefore, both sides of the tow are heated, and thus it is beneficial to increasing a crystallinity and a degree of orientation of a fiber, and a strength and a modulus of the fiber can be gradually increased. A step-by-step drawing can be achieved by using multi-stage drawing hot rollers, and therefore the industrial bio-based polyamide filament of 55 dtex-2222 dtex can be spun, so that it can be used to spin a fine denier bio-based polyamide fiber of 55 dtex-111 dtex and a coarse denier bio-based polyamide fiber of 1670 dtex-2222 dtex.

DETAILED DESCRIPTION

Embodiment One

Referring to FIG. 1 to FIG. 18, the embodiment discloses a spinning-drawing-winding device for industrial bio-based polyamide which sequentially includes, along a traveling direction of a tow, a feeding-splitting filament tension roller 1400, a first pair of drawing hot rollers 1600, a second pair of drawing hot rollers 1700, a third pair of drawing hot rollers 1800, a fourth pair of drawing hot rollers 1900 and a fifth pair of drawing hot rollers 2000. Two adjacent rotational directions among a rotational direction of the tow winding through the first pair of drawing hot rollers 1600, a rotational direction of the tow winding through the second pair of drawing hot rollers 1700, a rotational direction of the tow winding through the third pair of drawing hot rollers 1800, a rotational direction of the tow winding through the fourth pair of drawing hot rollers 1900 are opposite to spin an industrial bio-based polyamide filament of 55 dtex-2222 dtex.

Figure 1:
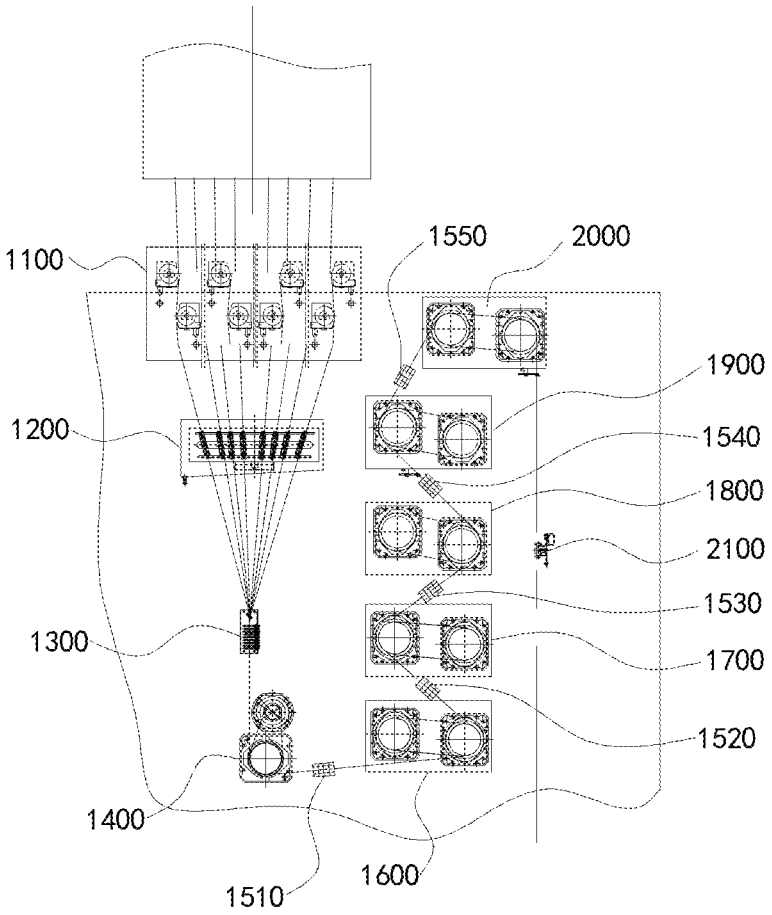
FIG. 1 shows a structural schematic diagram of a spinning-drawing-winding device for industrial bio-based polyamide according to Embodiment One of the disclosure.
Figure 2:
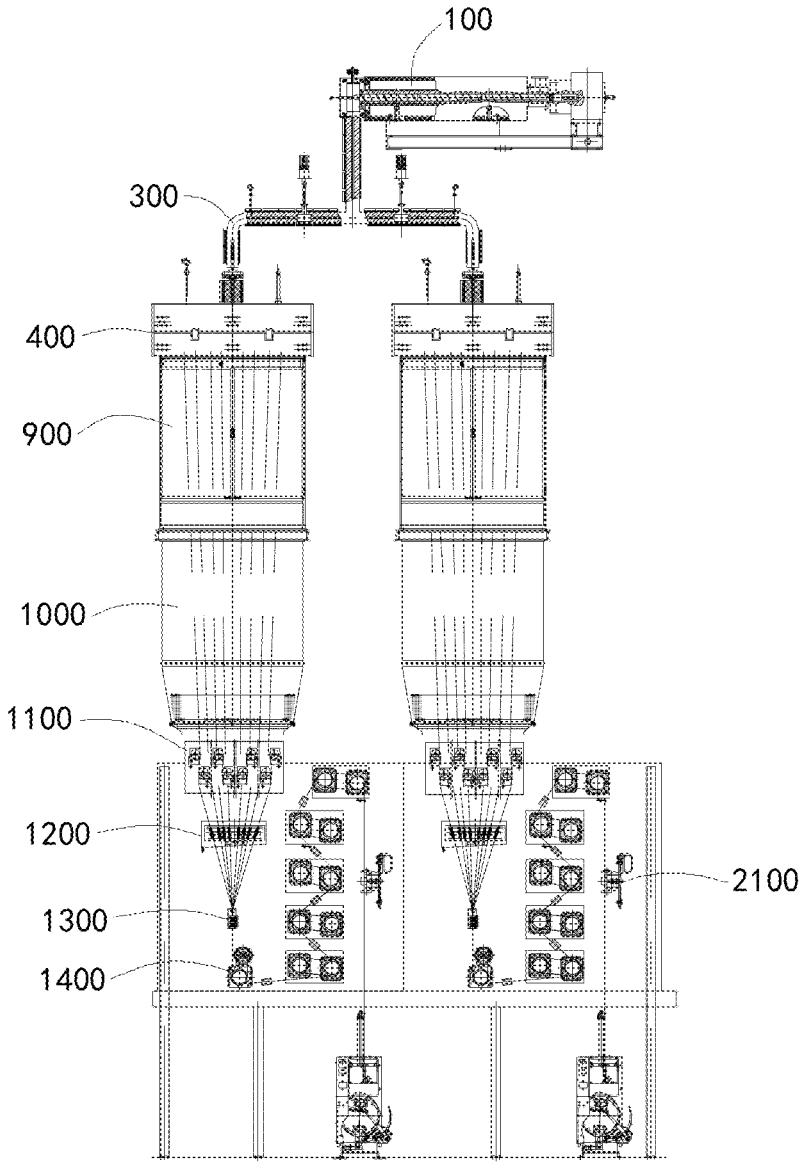
FIG. 2 shows an overall structural schematic diagram of a combined spinning-drawing-winding machine shown in FIG. 1.
Figure 3:
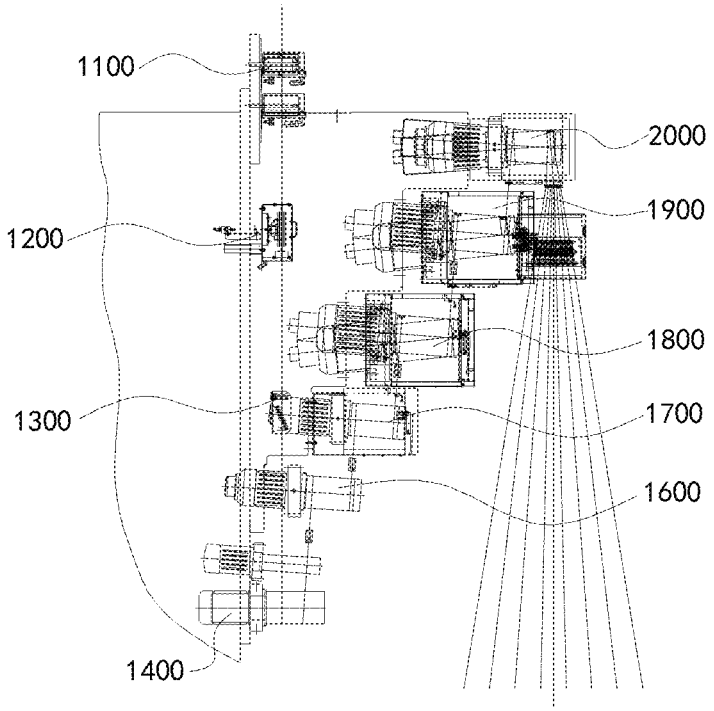
FIG. 3 is a side view of a structure in the FIG. 1.

In some embodiments, referring to FIG. 1 and FIG. 3, the tow sequentially passes through the feeding-splitting filament tension roller 1400, the first pair of drawing hot rollers 1600, the second pair of drawing hot rollers 1700, and the third pair of drawing hot rollers 1800, the fourth pair of drawing hot rollers 1900 and the fifth pair of drawing hot rollers 2000, and then is wound onto a winding machine through a final interlacer 2100. In some embodiments, the tow, before passing through the feeding-splitting filament tension roller 1400, comes down from a spinning assembly, and then passes through an oiling mechanism 1100, a pre-interlacer 1200 and a filament guider 1300 in sequence, and then passes through the feeding-splitting filament tension roller 1400.

In this embodiment, a peripheral side of the tow is divided into a M surface 10 and a N surface 20 of the tow for easy of description. It should be explained that clockwise and counterclockwise directions in the following description are based on the drawings.

Figure 4:
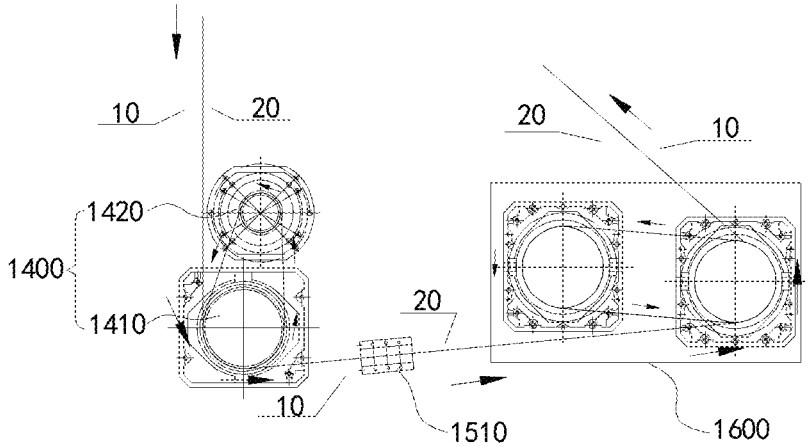
FIG. 4 is a schematic diagram of a traveling of a tow from a feeding-splitting filament tension roller to a first pair of drawing hot rollers in FIG. 1.
Figure 5:
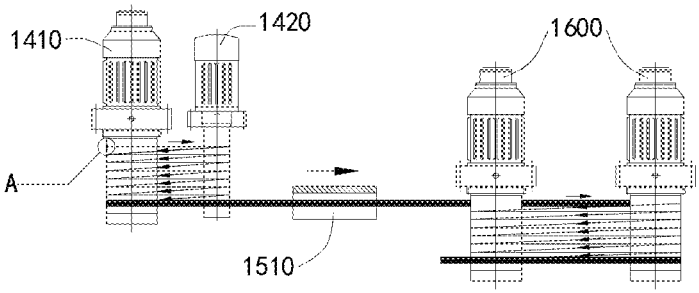
FIG. 5 is a top view of a structure in FIG. 4.
Figure 6:
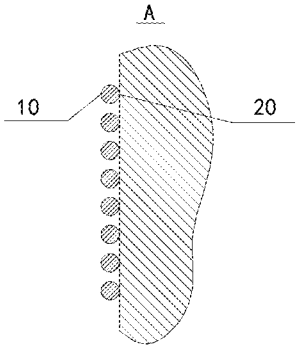
FIG. 6 is an enlarged schematic diagram of a portion indicated by A in FIG. 5.
Figure 7:
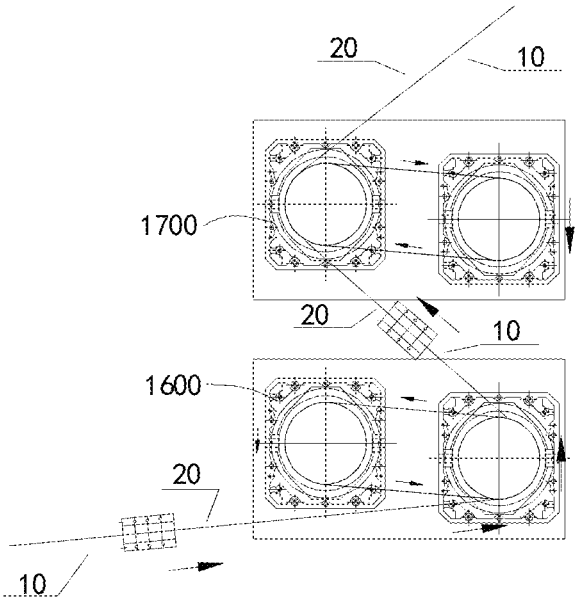
FIG. 7 is a schematic diagram of the traveling of the tow from the first pair of drawing hot rollers to a second pair of drawing hot rollers in FIG. 1.
Figure 8:
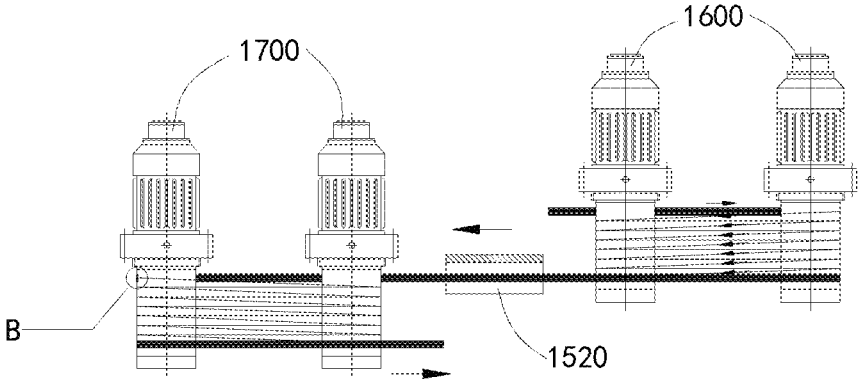
FIG. 8 is a top view of a structure in FIG. 7.
Figure 9:
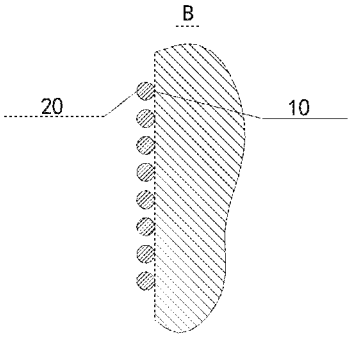
FIG. 9 is an enlarged schematic diagram of a portion indicated by B in FIG. 8.
Figure 10:
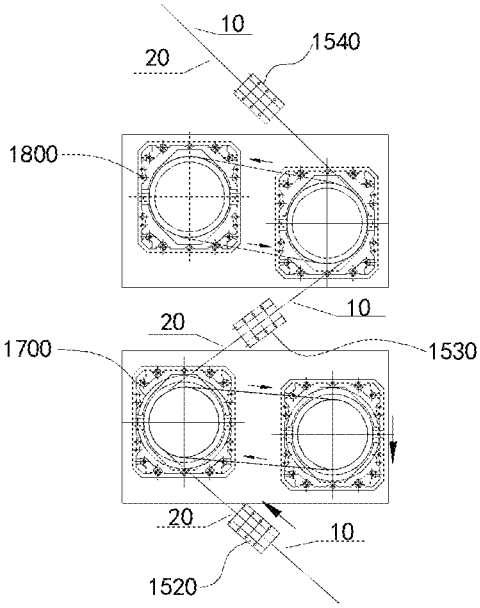
FIG. 10 is a schematic diagram of the traveling of the tow from the second pair of drawing hot rollers to a third pair of drawing hot rollers in FIG. 1.
Figure 11:
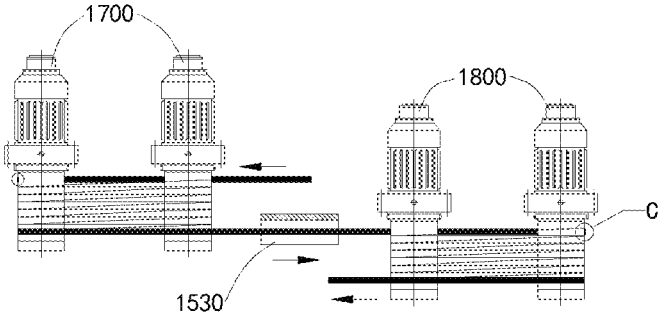
FIG. 11 is a top view of a structure in FIG. 10.
Figure 12:
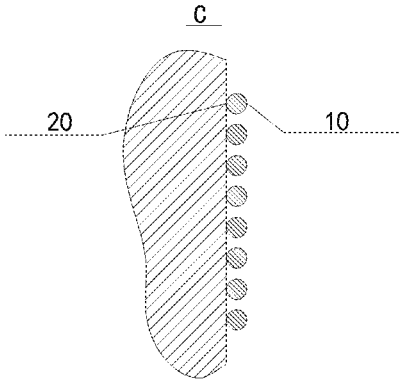
FIG. 12 is an enlarged schematic diagram of a portion indicated by C in FIG. 11.
Figure 13:
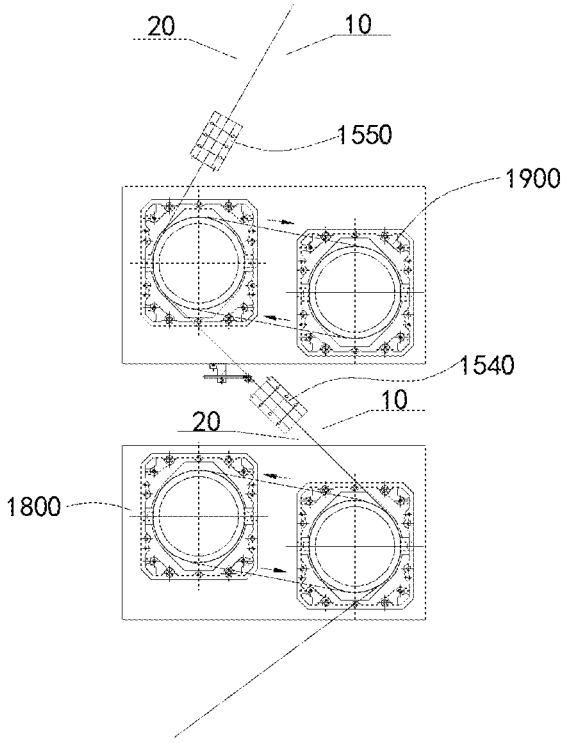
FIG. 13 is a schematic diagram of the traveling of the tow from the third pair of drawing hot rollers to a fourth pair of drawing hot rollers in FIG. 1.
Figure 14:
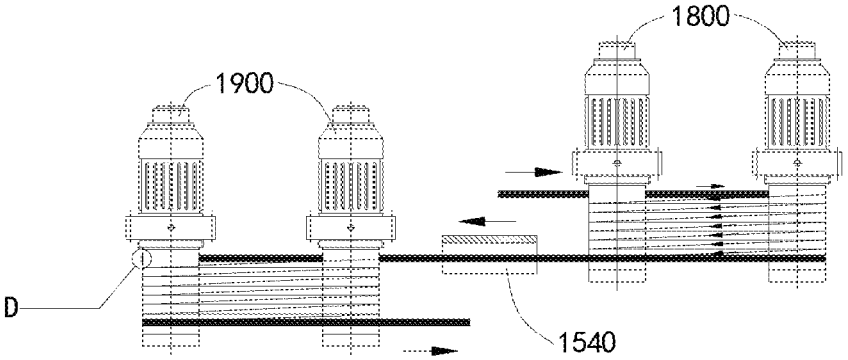
FIG. 14 is a top view of a structure in FIG. 13.
Figure 15:
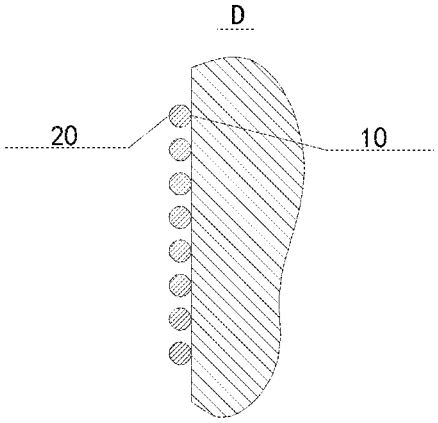
FIG. 15 is an enlarged schematic diagram of a portion indicated by D in FIG. 14.

Referring to FIG. 4 to FIG. 6, when the tow travels from the feeding-splitting filament tension roller 1400 to the first pair of drawing hot rollers 1600, the rotational direction of the tow winding through the feeding-splitting filament tension roller 1400 is the counterclockwise direction, and the rotational direction of the tow winding through the first pair of drawing hot rollers 1600 is the counterclockwise direction. The feeding-splitting filament tension roller 1400 directly contacts and heats the N surface 20 of the tow, and the first pair of drawing hot rollers 1600 directly contact and heat the N surface 20 of tow. Referring to FIG. 7 to FIG. 9, the rotational direction of the tow winding through the second pair of drawing hot rollers 1700 is the clockwise direction, and the second pair of drawing hot rollers 1700 directly contact and heat the M surface 10 of tow. Referring to FIG. 10 to FIG. 12, the rotational direction of the tow winding through the third pair of drawing hot rollers 1800 is the counterclockwise direction, and the third pair of drawing hot rollers 1800 directly contact and heat the N surface 20 of the tow. Referring to FIG. 13 to FIG. 15, the rotational direction of the tow winding through the fourth pair of drawing hot rollers 1900 is the clockwise direction, and the fourth pair of drawing hot rollers 1900 directly contact and heat the M surface 10 of the tow.

Therefore, the N surface 20 of the tow, the M surface 10 of the tow, the N surface 20 of the tow, and the M surface 10 of the tow are sequentially contacted and heated respectively by the first pair of drawing hot rollers 1600 up to the fourth pair of drawing hot rollers 1900, and thus it is beneficial to increasing a crystallinity and a degree of orientation of a fiber, and a strength and a modulus of the fiber can be gradually increased. A step-by-step drawing can be achieved by using multi-stage drawing hot rollers, and therefore the industrial bio-based polyamide filament of 55 dtex-2222 dtex can be spun, so that it can be used to spin a fine denier bio-based polyamide fiber of 55 dtex-111 dtex and a coarse denier bio-based polyamide fiber of 1670 dtex-2222 dtex.

Figure 16:
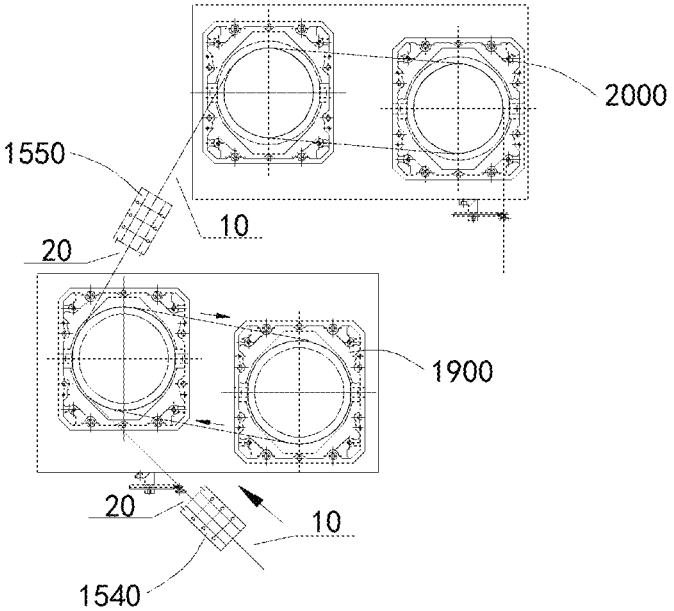
FIG. 16 is a schematic diagram of the traveling of the tow from the fourth pair of drawing hot rollers to a fifth pair of drawing hot rollers in FIG. 1.
Figure 17:
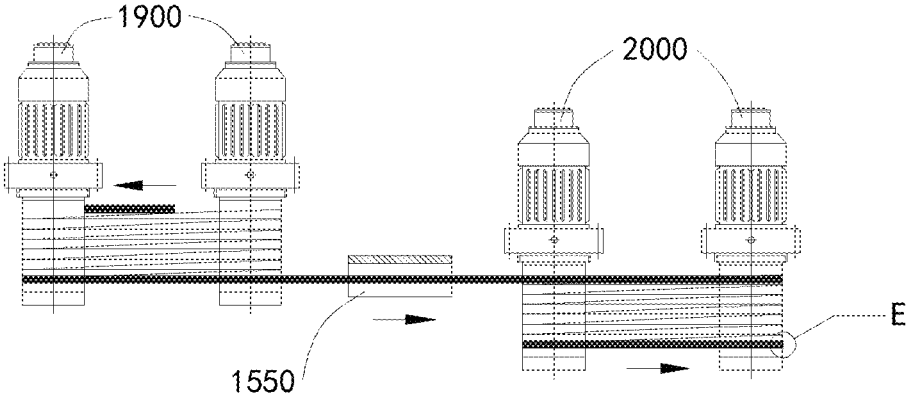
FIG. 17 is a top view of a structure in FIG. 16.
Figure 18:
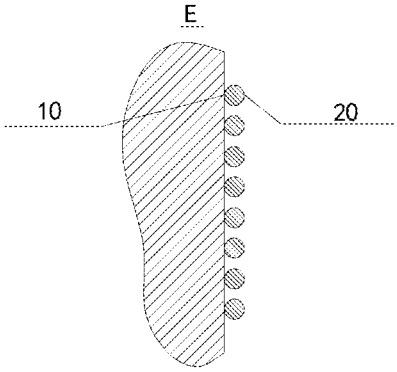
FIG. 18 is an enlarged schematic diagram of a portion indicated by E in FIG. 17.

In some embodiments, referring to FIG. 16 to FIG. 18, the rotational direction of the tow winding through the fifth pair of drawing hot rollers 2000 is the clockwise direction, and the fifth pair of drawing hot rollers 2000 directly contact and heat the M surface 10 of the tow, so that the tow hangs down from a right side as shown in FIG. 1, and enters the winding machine through the final interlacer 2100, and it is beneficial to an overall layout of the device.

In some embodiments, referring to FIG. 1 to FIG. 18, the device may along a traveling direction of the tow, sequentially include a feeding-splitting filament tension roller 1400, a first heating plate 1510, a first pair of drawing hot rollers 1600, and a second heating plate 1520, a second pair of drawing hot rollers 1700, a third heating plate 1530, a third pair of drawing hot rollers 1800, a fourth heating plate 1540, a fourth pair of drawing hot rollers 1900, a fifth heating plate 1550 and a fifth pair of drawing hot rollers 2000. The first heating plate 1510, the second heating plate 1520, the third heating plate 1530, the fourth heating plate 1540 and the fifth heating plate 1550 each heat the tow in areas between two adjacent rollers.

In some embodiments, the tow is stretched for the first time on the first pair of drawing hot rollers 1600. In order to maintain a certain tension in the tow, both sides of the tow are first heated and preheated through the first heating plate 1510, and then the tow enters the first pair of drawing hot rollers 1600, which is helpful to overcome problems such as an end breakage and a poor spinnability in an initial draw. The second heating plate 1520 disposed between the first pair of drawing hot rollers 1600 and the second pair of drawing hot rollers 1700 is conducive to improving the crystallinity and the orientation degree of the fiber, and the strength and modulus of the fiber can be gradually increased. The third heating plate 1530, disposed between the second pair of drawing hot rollers 1700 and the third pair of drawing hot rollers 1800, improves a consistency of internal and external temperatures of the tow and improves a uniformity of heating of the tow to facilitate heating and drawing in a subsequent process. The fourth heating plate 1540, disposed between the third pair of drawing hot rollers 1800 and the fourth pair of drawing rollers 1900, further improves the consistency of internal and external temperatures of the tow and improves the uniformity of heating of the tow to facilitate the heating and drawing in a subsequent process. The fifth heating plate 1550, disposed between the fourth pair of drawing hot rollers 1900 and the fifth pair of drawing hot rollers 2000, further improves the consistency of the internal and external temperatures of the tow and improves the uniformity of heating of the tow to facilitate shaping and retraction in a subsequent process.

In some embodiments, as shown in FIG. 4, the feeding-splitting filament tension roller 1400 adopts a fixed cold roller 1410 cooperating with an angle-adjustable splitting filament roller 1420, while the first pair of drawing hot rollers 1600, the second pair of drawing hot rollers 1700, the third pair of drawing hot rollers 1800, the fourth pair of drawing hot rollers 1900 and the fifth pair of drawing hot rollers 2000 each adopt an angle-adjustable hot roller cooperating with an angle-adjustable hot roller.

The first pair of drawing hot rollers 1600 are low-temperature rollers that preliminarily heat the tow, while the second pair of drawing hot rollers 1700, the third pair of drawing hot rollers 1800, the fourth pair of drawing hot rollers 1900, and the fifth pair of drawing hot rollers 2000 each are high-temperature rollers, which further heat the tow to draw, slack and shape.

A draw ratio between the feeding-splitting filament tension roller 1400 and the first pair of drawing hot rollers 1600 is maintained at 1:(1.04-1.08), so that the tow maintains a certain tension. A draw multiple of the first pair of drawing hot rollers 1600 and the second pair of drawing hot rollers 1700 is 1.5 to 3.5 times, and this level of drawing is conducive to a high degree of orientation and a lower crystallinity. A draw multiple of the second pair of drawing hot rollers 1700 and the third pair of drawing hot rollers 1800 is 2.0 to 3.5 times to form a secondary heating and drawing. A draw multiple of the third pair of drawing hot rollers 1800 and the fourth pair of drawing hot rollers 1900 is generally 1.7 to 2.5 times to improve a uniformity and a draw multiple of the fiber, and to improve the strength of the tow. A draw multiple of the fourth pair of drawing hot rollers 1900 and the fifth pair of drawing hot rollers 2000 is 0.9-1.0 times, and there is a certain retraction of the fiber between the fourth pair of drawing hot rollers 1900 and the fifth pair of drawing hot rollers 2000, and therefore the tow drawn are shaped to eliminate a stress caused by a high-speed drawing. Therefore a low shrinkage rate is better controlled.

A spinning-drawing-winding device for industrial bio-based polyamide according to an embodiment is used to spin the industrial bio-based polyamide filament of 55 dtex-2222 dtex, including the industrial bio-based polyamide filament of 55 dtex-111 dtex, and the industrial bio-based polyamide filament of 1670 dtex-2222 dtex.

In some embodiments, the bio-based polyamide fiber tow, through a filament guider 1300, enters a filament path for turning and guiding filaments. The filament path is changed as 0°-90° and then the tow enters the feeding-splitting filament tension roller 1400 which adopts a combination of the fixed cold roller 1410 (φ (110-220)×400 mm) and the angle-adjustable splitting filament roller 1420 (φ (55-110)× 400 mm), and a surface of a roller shell is chromium oxide and alumina. The tow after being turned by 90° moves vertically downward to tangentially contact a rear end of an effective area of a cylindrical surface of the fixed cold roller 1410, as shown in FIG. 4. Referring to FIG. 5, the tow is wound counterclockwise for half a circle from a left side of the cylindrical surface of the fixed cold roller 1410, and then pulled out tangentially from a right side of the cylindrical surface of the fixed cold roller 1410, and then enters a right side of a cylindrical surface of the angle-adjustable splitting filament roller 1420 and is wound for half a circle counterclockwise and then is pulled out tangentially from a left side of the cylindrical surface of the angle-adjustable splitting filament roller 1420 and then enters the left side of the cylindrical surface of the fixed cold roller 1410. At this moment, as the angle-adjustable splitting filament roller 1420 has a function of adjusting an angle and a front section of a cylindrical roller body of the angle-adjustable splitting roller 1420 is inclined downward, and therefore the tow, wound half a circle on the cylindrical surface of the angle-adjustable splitting filament roller 1420, will have a certain movement of position on a surface of the roller body toward a front end of the roller body (as shown in FIG. 5). In this way, the tow is continuously wound counterclockwise between the fixed cold roller 1410 and the angle-adjustable splitting filament roller 1420 for 1 to 5 circles, and is pulled out counterclockwise from a lower tangent point of a front end of a cylindrical roller surface of the fixed cold roller 1410 after a last circle is completed. The winding on the feeding-splitting filament tension roller 1400 without heating is to hold a nascent tow and give the tow a certain speed. The tow is cooled and shaped under a pulling of the feeding-splitting filament tension roller 1400, and a spinning draw is completed to form nascent fibers. The tow enters the first heating plate 1510 at a speed of 550-750 m/min. At this moment, a surface of the tow in contact with the surface of the roller shell of the feeding-splitting filament tension roller 1400 is the N surface 20 of the tow, and n tows are spreaded on the surface of the roller shell evenly, and in this way a spinning tension can be increased to be enough to reduce a swing of a spun fiber. Since a speed ratio of the feeding-splitting filament tension roller 1400 and the first pair of drawing hot rollers 1600 is maintained as 1:(1.04-1.08), so that the tow is kept with a certain tension. It is required to preheat the tow to be drawn. The tow is pulled by the first pair of drawing hot rollers 1600, and passes through the first heating plate 1510. M surfaces 10 and the N surfaces 20 of the n tows each are heated in the first heating plate 1510.

When the industrial bio-based polyamide filament of 55 dtex-111 dtex is spun, a total denier and a single filament denier are all lower. The nascent fiber is prone to abnormal phenomena such as the end breakage during the initial drawing, and therefore a heating environment with a relatively low temperature is required. As shown in FIG. 5, the n tows coming out of the feeding-splitting filament tension roller 1400 at a speed of 720 m/min pass through the first heating plate 1510. In the first heating plate 1510, the M surfaces 10 and the N surfaces 20 of the n tows are all heated. At this moment, a heating temperature is relatively low at 50-65° C., and a continuous low-temperature preheating is performed on the tow with a thinner cross-section, so that the inside of the tow is heated as much as possible in the heating plate to improve a penetration of heat. Then the n tows enter the first pair of drawing hot rollers 1600. The first pair of drawing hot rollers 1600 adopts an angle-adjustable hot roller plus an angle-adjustable hot roller. Shell surfaces of the first pair of drawing hot rollers 1600 are chromium oxide plus alumina. The first pair of drawing hot rollers 1600 are (2×φ (190-250)×(350-450) mm) in size, and are the low-temperature rollers. The tow is wound on roller surfaces of the first pair of drawing hot rollers 1600 for 6.5 to 7.5 circles, and a temperature of the first pair of drawing hot rollers 1600 is set as 75-100° C. In some embodiments, the temperature is 90° C., and a spinning speed is 700-800 m/min. The tow is spread stably on roller surfaces of the first pair of drawing hot rollers 1600, and wound counterclockwise for 6.5 to 7.5 circles on the roller surfaces of the first pair of drawing hot rollers 1600. At this moment, the surface of the tow heated on the surface of the roller shell is the N surface.

When the industrial bio-based polyamide filament of 1670 dtex-2222 dtex is spun, the total denier and the single filament denier are all higher. The nascent fiber is also prone to abnormal phenomena such as the end breakage during the initial drawing. At the same time, a poor spinnability during spinning, a too high bending strength of the tow and a hard hand-feeling will be caused due to the two high total denier and single filament denier. A heating environment with a relatively high temperature is required. As shown in FIG. 4 and FIG. 5, the n tows coming out of the feeding-splitting filament tension roller 1400 at a speed of 650 m/min pass through the first heating plate 1510. In the first heating plate 1510, the M surfaces 10 and the N surfaces 20 of the n tows each are heated. At this moment, a heating temperature is relatively low at 70-90° C., and a continuous relatively high-temperature preheating is performed on the tow with a thinner cross-section, so that the inside of the tow is heated as much as possible in the heating plate to improve a penetration of heat, and then the n tows enter the first pair of drawing hot rollers 1600. The first pair of drawing hot rollers 1600 adopts the angle-adjustable hot roller plus the angle-adjustable hot roller. Shell surfaces of the first pair of drawing hot rollers 1600 are chromium oxide plus alumina. The first pair of drawing hot rollers 1600 are (2×φ (190-250)×(350-450) mm) in size, and are the low-temperature rollers. The tow is wound on the roller surfaces of the first pair of drawing hot rollers 1600 for 6.5 to 7.5 circles, and a temperature of the first pair of drawing hot rollers 1600 is set as 75-100° C. In some embodiments, the temperature is 90° C., and a spinning speed is 700-800 m/min. The tow is spread stably on the surfaces of the first pair of drawing hot rollers 1600, and wound for 6.5 to 7.5 circles on the roller surfaces of the first pair of drawing hot rollers 1600. At this moment, the surface of the tow heated on the surface of the roller shell is the N surface.

In some embodiments, as shown in FIG. 7 to FIG. 9, the tow after being wound on the first pair of drawing hot rollers 1600, is pulled out from a right roller of the first pair of drawing hot rollers 1600 and then transferred to the second heating plate 1520. In the second heating plate 1520, the M surfaces 10 and the N surfaces 20 of the n tows each are heated. The n tows are evenly spread on a surface of a left roller of the second pair of drawing hot rollers 1700. At this moment, the surface of the tow heated on the surface of the roller shell is the M surface. The second pair of drawing hot rollers 1700 adopts the angle-adjustable hot roller plus the angle-adjustable hot roller. Shell surfaces of the second pair of drawing hot rollers 1700 are chromium oxide plus alumina. The second pair of drawing hot rollers 1700 are high-temperature rollers. The second pair of drawing hot rollers 1700 are (2×φ(190-250)×(350-450) mm) in size. The first pair of drawing hot rollers 1600 are the low-temperature rollers with a temperature set as 75-100° C., and the second pair of drawing hot rollers 1700 are the high-temperature rollers with a temperature set as 110-145° C., and therefore a temperature of the tow can be gradually and steadily increased, which is conducive to gradual orientation and crystallization of the fibers to achieve mechanical properties of the fibers of the industrial bio-based polyamide filament. The second heating plate 1520 is placed so that each filament passes between heaters individually and will be stably spread on the surfaces of the second pair of drawing hot rollers 1700, thereby improving the consistency between the internal and external temperatures of the tow and improving the uniformity of heating of the tow to facilitate the heating and drawing in the subsequent process. From the first pair of drawing hot rollers 1600 to the second pair of drawing hot rollers 1700, heated surfaces of the tow are reversed. At this moment, the surface of the tow heated on the surface of the roller shell is the M surface. The M surface of the tow is also heated during this process, and is further heated by the second heating plate 1520, and thus it is beneficial to improving the crystallinity and degree of orientation of the fiber, and the strength and modulus of the fiber can be gradually increased. The second heating plate 1520 is set with a temperature of 95-115° C. The tow, after passing through the second heating plate 1520, is transferred to the second pair of drawing hot rollers 1700. The tow is wound clockwise for 6.5 to 7.5 circles on the roller surfaces of the second pair of drawing hot rollers 1700, and the spinning speed is 1680 m/min. The draw multiple of the first pair of drawing hot rollers 1600 and the second pair of drawing hot rollers 1700 is generally 1.5 to 3.5 times. This level of drawing is to obtain a high orientation and a low crystallinity. When the industrial bio-based polyamide filament of 55 dtex-111 dtex is spun in comparation with the industrial bio-based polyamide filament of 1670 dtex-2222 dtex, the total denier and single filament denier are lower, and a heated area is small, and a heating environment of relative 5-10° C. lower is required. The draw ratio is 5%-10% smaller since a filament is relatively thin.

In some embodiments, as shown in FIG. 10 to FIG. 12, the tow after being wound on the second pair of drawing hot rollers 1700, is pulled by the third pair of drawing hot rollers 1800 and passes through the third heating plate 1530 in which all the M surfaces 10 and the N surfaces 20 of the n tows are heated. The tows are spread stably on surfaces of the third pair of drawing hot rollers 1800. The tows are wound for 6.5 to 7.5 circles on surfaces of two rollers of the third pair of drawing hot rollers 1800. The n tows are evenly spread on the surface of the roller shell. The surface of the tow heated on the surface of the roller shell is the N surface. Therefore, a certain degree of strength and elongation can be obtained at this level of drawing. When the industrial bio-based polyamide filament of 55 dtex-111 dtex is spun in comparation with the industrial bio-based polyamide filament of 1670 dtex-2222 dtex, the total denier and single filament denier are lower, a heated area is small, a heating environment of relative 5-15° C. lower is required. The draw ratio is 4%-12% smaller since a filament is relatively thin. The third heating plate 1530 is set with a temperature of 110-155° C. The tow, after passing through the third heating plate 1530, is transferred to the third pair of drawing hot rollers 1800. The third pair of drawing hot rollers 1800 adopts the angle-adjustable hot roller plus the angle-adjustable hot roller. Shell surfaces of the third pair of drawing hot rollers 1800 are chromium oxide plus alumina. The third pair of drawing hot rollers 1800 are (2×φ (190-250)×(350-450) mm) in size, and are the high-temperature rollers. The tow is wound on the roller surfaces of the third pair of drawing hot rollers 1800 for 6.5 to 7.5 circles, and a temperature of the third pair of drawing hot rollers 1800 is set as 130-150° C. In some embodiments the temperature is 140° C., and a spinning speed is 2520 m/min. The draw multiple of the second pair of drawing hot rollers 1700 and the third pair of drawing hot rollers 1800 is 2.0 to 3.5 times to form a secondary heating and drawing. The temperature of the tow can be gradually and steadily increased, and the uniformity and draw multiple of the fiber are improved and the strength of the tow is improved. The third heating plate 1530 is placed so that each filament passes between heaters individually and will be stably spread on the surfaces of the third pair of drawing hot rollers 1800, thereby further improving the consistency between the internal and external temperatures of the tow and improving the uniformity of heating of the tow to facilitate the heating and drawing in the subsequent process. From the second pair of drawing hot rollers 1700 to the third pair of drawing hot rollers 1800, the heated surfaces of the tow are reversed again. At this moment, the surface of the tow heated on the surface of the roller shell is the N surface. Both surfaces of the tow are heated, and are further heated by the third heating plate 1530, and thus it is beneficial to improving the crystallinity and degree of orientation of the fiber, and the strength and modulus of the fiber can be gradually increased.

In some embodiments, as shown in FIG. 13 to FIG. 15, the tow after being wound on the third pair of drawing hot rollers 1800, is pulled by the fourth pair of drawing hot rollers 1900 and passes through the fourth heating plate 1540 in which all the M surfaces 10 and the N surfaces 20 of the n tows are heated. The tows are spread stably on surfaces of the fourth pair of drawing hot rollers 1900. The tows are wound for 6.5 to 7.5 circles on surfaces of two rollers of the fourth pair of drawing hot rollers 1900. The n tows are evenly spread on the surface of the roller shell. At this moment, the surface of the tow heated on the surface of the roller shell is the M surface. This level of drawing is also to obtain a certain strength and elongation, and has a certain pre-shaping effect. When the industrial bio-based polyamide filament of 55 dtex-111 dtex is spun in comparation with the industrial bio-based polyamide filament of 1670 dtex-2222 dtex is spun, and the total denier and single filament denier are lower, and a heated area is small, and a heating environment of relative 2-10° C. lower is required. The draw ratio is 2%-8% smaller since a filament is relatively thin. A temperature of the fourth heating plate 1540 is set as 125-195° C. A third heating and drawing is formed between the third pair of drawing hot rollers 1800 and the fourth pair of drawing hot rollers 1900. The draw multiple is generally 1.7~2.5 times. Therefore, the temperature of the tow can further be gradually and steadily increased, the uniformity and draw multiple of the fiber are improved and the strength of the tow is improved. The fourth heating plate 1540 is placed so that each filament passes between heaters individually and will be stably spread on the surfaces of the fourth pair of drawing hot rollers 1900, thereby further improving the consistency between the internal and external temperatures of the tow and improving the uniformity of heating of the tow to facilitate the heating and drawing in the subsequent process. From the third pair of drawing hot rollers 1800 to the fourth pair of drawing hot rollers 1900, the heated surfaces of the tow are reversed again, at this moment, the surface of the tow heated on the surface of the roller shell is the M surface. Both surfaces of the tow are heated, and are further heated by the heating of the fourth heating plate 1540, and thus it is conducive to an increase in the degree of orientation and a grain size of a crystallization zone and a perfection of the crystallization zone in a subsequent drawing. The tow, after passing through the fourth heating plate 1540, is transferred to the fourth pair of drawing hot rollers 1900. The fourth pair of drawing hot rollers 1900 adopts an angle-adjustable hot roller cooperating with an angle-adjustable hot roller, and a shell surface of the hot rollers is ceramic. The fourth pair of drawing hot rollers 1900 are (2×φ(190-235)×(350-400) mm) in size, and are the high-temperature roller, and the temperature is set as 130-150° C. The tow is wound around 6.5 to 7.5 circles on the roller surface of the fourth pair of drawing hot rollers 1900, and a spinning speed is 3650 m/min.

In some embodiments, as shown in FIG. 16 to FIG. 18, the tow after being wound on the fourth pair of drawing hot rollers 1900, tow is pulled by the fifth pair of drawing hot rollers 2000 and passes through the fifth heating plate 1550. A temperature of the fifth heating plate 1550 is set as 140-220° C. In the fifth heating plate 1550, the M surfaces 10 and the N surfaces 20 of the n tows each are heated. The tows are spread stably on surfaces of the fifth pair of drawing hot rollers 2000. The tows are wound for 6.5 to 7.5 circles on surfaces of two rollers of the fifth pair of drawing hot rollers 2000. The n tows are evenly spread on the surface of the roller shell. At this moment, the surface of the tow heated on the surface of the roller shell is the M surface. This level plays a role in slacking and shaping. When the industrial bio-based polyamide filament of 55 dtex-111 dtex is spun in comparation with the industrial bio-based polyamide filament of 1670 dtex-2222 dtex, the total denier and single filament denier are lower, a heated area is small, a heating environment of relative 1-4° C. lower is required. A slack ratio is 1%-3% smaller since a filament is relatively thin. The draw multiple of the fourth pair of drawing hot rollers 1900 and the fifth pair of drawing hot rollers 2000 is generally 0.9-1.0 times. A speed of the fifth pair of drawing hot rollers 2000 is slightly lower than that of the fourth pair of drawing hot rollers, and therefore there is a certain amount of retraction of the fibers between the fourth pair of drawing hot rollers 1900 and the fifth pair of drawing hot rollers 2000 to complete a shaping of high-strength filaments, and therefore a main function of shaping drawn tows is achieved and a stress of the fibers caused by a high-speed drawing is eliminated. Therefore, the low shrinkage rate is better controlled. The fifth heating plate 1550 is placed so that each filament passes between heaters individually and will be stably spread on the surfaces of the fifth pair of drawing hot rollers 2000, thereby further improving the consistency between the internal and external temperatures of the tow and improving the uniformity of heating of the tow to facilitate the shaping and retraction in the subsequent process. The tow, after passing through the fifth heating plate 1550, is transferred to the fifth pair of drawing hot rollers 2000. The fifth pair of drawing hot rollers 2000 adopts the angle-adjustable hot roller plus the angle-adjustable hot roller, and a shell surface of the hot roller is ceramic, The fifth pair of drawing hot rollers 2000 are (2×φ (190-220)× (350-400) mm) in size and are the high-temperature roller. The tow is wound around 6.5 to 7.5 circles on the roller surfaces of the fifth pair of drawing hot rollers 2000 and a temperature of the fifth pair of drawing hot rollers 2000 is set as 130-210° C. and a spinning speed is 3550 m/min.

In some embodiments, a spinning-drawing-winding device is used for spinning a fine denier bio-based polyamide fiber of 55 dtex-111 dtex, a coarse denier bio-based polyamide fiber of 1670 dtex-2222 dtex, and can also be used for spinning a bio-based polyamide fiber of 111 dtex-1670 dtex.

Figure 19:
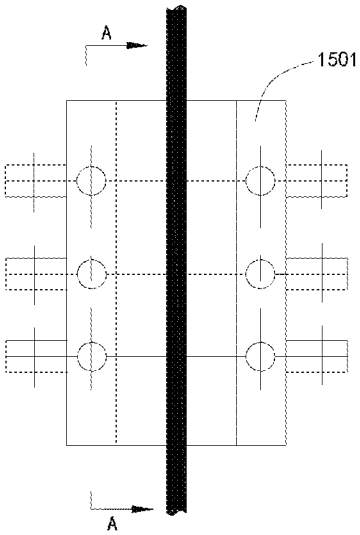
FIG. 19 is a structural schematic diagram of a heating plate shown in FIG. 1.
Figure 20:
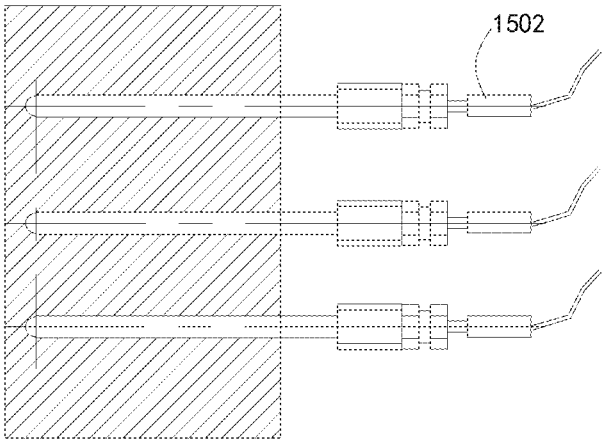
FIG. 20 is a schematic cross-sectional view taken along A-A in FIG. 19.
Figure 21:
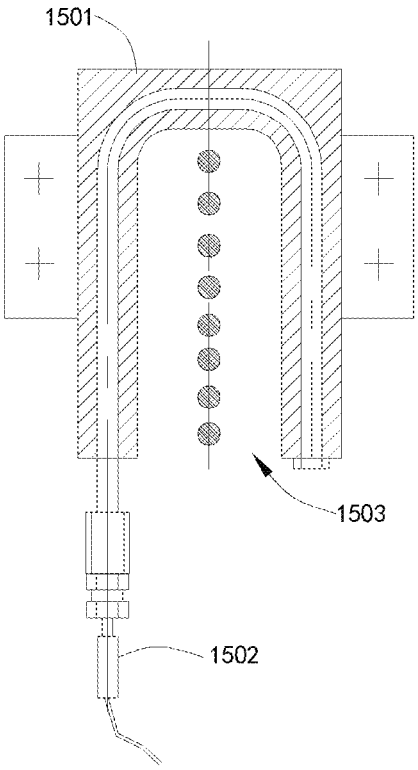
FIG. 21 is another schematic cross-sectional view of the heating plate in FIG. 19.

In some embodiments, as shown in FIG. 19 to FIG. 21, each heating plate can include a heat transfer block 1501 and a plurality of heating rods 1502. The heat transfer block 1501 is provided with an opening slot 1503 for the tow to pass through. The plurality of heating rods 1502 are arranged sequentially along a length direction of the opening slot 1503. Though three heating rods 1502 are shown in the figures, the number of the heating rods 1502 can be more or less. The heating rods 1502 are arranged in a shape of hook which is formed with a hook portion and a hook groove. The hook portion is disposed within the heat transfer block 1501, and the hook groove is for the tow to pass through. Both sides of the tow passing through can be fully and evenly heated by the heating plate.

Embodiment Two

Referring to FIG. 1 to FIG. 18 and FIG. 30 to FIG. 33, this embodiment discloses a combined spinning-drawing-winding machine for industrial bio-based polyamide, which can include the following disposed in sequence according to a production process: a screw extruder 100, a melt pipe 300, a spinning box 400, a metering pump 500, a spinning assembly 600, a heat-retarder 700, a monomer suction mechanism 800, a side blowing component 900, a spinning channel component 1000, a double-surface oiling mechanism 1100, a pre-interlacer 1200, a filament guider 1300, a feeding-splitting filament tension roller 1400, a first heating plate 1510, a first pair of drawing hot rollers 1600, a second heating plate 1520, a second pair of drawing hot rollers 1700, a third heating plate 1530, a third pair of drawing hot rollers 1800, a fourth heating plate 1540, a fourth pair of drawing hot rollers 1900, a fifth heating plate 1550, a fifth pair of drawing hot rollers 2000, a final interlacer 2100 and a fully automatic winding head.

In some embodiments, the first heating plate 1510, the second heating plate 1520, the third heating plate 1530, the fourth heating plate 1540 and the fifth heating plate 1550 each heat tows in areas between two adjacent rollers. Two adjacent rotational directions among a rotational direction of the tow winding through the first pair of drawing hot rollers 1600, a rotational direction of the tow winding through the second pair of drawing hot rollers 1700, a rotational direction of the tow winding through the third pair of drawing hot rollers 1800, a rotational direction of the tow winding through the fourth pair of drawing hot rollers 1900 are in opposite to spin an industrial bio-based polyamide filament of 55 dtex-2222 dtex.

In some embodiments, referring to FIG. 1 and FIG. 3, the tow sequentially passes through the feeding-splitting filament tension roller 1400, the first pair of drawing hot rollers 1600, the second pair of drawing hot rollers 1700, the third pair of drawing hot rollers 1800, the fourth pair of drawing hot rollers 1900 and the fifth pair of drawing hot rollers 2000, and then is wound onto a winding machine through a final interlacer 2100. In some embodiments, the filament, before passing through the feeding-splitting filament tension roller 1400, comes down from a spinning assembly, passes through an double-surface oiling mechanism 1100, a pre-interlacer 1200 and a filament guider 1300 in sequence, and then passes through the feeding-splitting filament tension roller 1400.

Please be noted that in this embodiment, a peripheral side of the tow is divided into a M surface 10 of the tow at a side and a N surface 20 of the tow at another side for easy of description. The clockwise and counterclockwise directions in the following descriptions are based on the drawings.

Referring to FIG. 4 to FIG. 6, when the tow travels from the feeding-splitting filament tension roller 1400 to the first pair of drawing hot rollers 1600, the rotational direction of the tow winding through the feeding-splitting filament tension roller 1400 is the counterclockwise direction, and the rotational direction of the tow winding through the first pair of drawing hot rollers 1600 is the counterclockwise direction. The feeding-splitting filament tension roller 1400 directly contacts and heats the N surface 20 of the tow, and the first pair of drawing hot rollers 1600 directly contact and heat the N surface 20 of the tow. Referring to FIG. 7 to FIG. 9, the rotational direction of the tow winding through the second pair of drawing hot rollers 1700 is the clockwise direction, and the second pair of drawing hot rollers 1700 directly contact and heat the M surface 10 of the tow. Referring to FIG. 10 to FIG. 12, the rotational direction of the tow winding through the third pair of drawing hot rollers 1800 is the counterclockwise direction, and the third pair of drawing hot rollers 1800 directly contact and heat the N surface 20 of the tow. Referring to FIG. 13 to FIG. 15, the rotational direction of the tow winding through the fourth pair of drawing hot rollers 1900 is the clockwise direction, and the fourth pair of drawing hot rollers 1900 directly contact and heat the M surface 10 of the tow.

Therefore, the N surface 20 of the tow, the M surface 10 of the tow, the N surface 20 of the tow, and the M surface 10 of the tow are sequentially contacted and heated respectively by the first pair of drawing hot rollers 1600 up to the fourth pair of drawing hot rollers 1900, and thus it is beneficial to increasing a crystallinity and a degree of orientation of a fiber, and a strength and a modulus of the fiber can be gradually increased. A step-by-step drawing can be achieved by using multi-stage drawing hot rollers, and therefore the industrial bio-based polyamide filament of 55 dtex-2222 dtex can be spun, so that it can be used to spin a fine denier bio-based polyamide fiber of 55 dtex-111 dtex and a coarse denier bio-based polyamide fiber of 1670 dtex-2222 dtex.

Referring to FIG. 16 to FIG. 18, the rotational direction of the tow winding through the fifth pair of drawing hot rollers 2000 is the clockwise direction, and the fifth pair of drawing hot rollers 2000 directly contact and heat the M surface 10 of the tow, so that the tow hangs down from a right side as shown in FIG. 1, and enter the winding machine through the final interlacer 2100, and it is beneficial to an overall layout of a combined machine.

In some embodiments, referring to FIG. 1 to FIG. 18, the combined machine may, along a traveling direction of the tow, sequentially include a feeding-splitting filament tension roller 1400, a first heating plate 1510, a first pair of drawing hot rollers 1600, and a second heating plate 1520, a second pair of drawing hot rollers 1700, a third heating plate 1530, a third pair of drawing hot rollers 1800, a fourth heating plate 1540, a fourth pair of drawing hot rollers 1900, a fifth heating plate 1550 and a fifth pair of drawing hot rollers 2000. The first heating plate 1510, the second heating plate 1520, the third heating plate 1530, the fourth heating plate 1540 and the fifth heating plate 1550 each heat the tows in areas between two adjacent rollers.

In some embodiments, the tow is stretched for the first time on the first pair of drawing hot rollers 1600. In order to maintain a certain tension in the tow, both sides of the tow are first heated and preheated through the first heating plate 1510, and then the tow enters the first pair of drawing hot rollers 1600, which is helpful to overcome problems such as an end breakage and a poor spinnability in an initial draw. The second heating plate 1520 disposed between the first pair of drawing hot rollers 1600 and the second pair of drawing hot rollers 1700 is conducive to improving the crystallinity and the degree of orientation of the fiber, and the strength and modulus of the fiber can be gradually increased. The third heating plate 1530, disposed between the second pair of drawing hot rollers 1700 and the third pair of drawing hot rollers 1800, improves a consistency of internal and external temperatures of the tow and improves a uniformity of heating of the tow to facilitate heating and drawing in a subsequent process. The fourth heating plate 1540, disposed between the third pair of drawing hot rollers 1800 and the fourth pair of drawing rollers 1900, further improves the consistency of internal and external temperatures of the tow and improves the uniformity of heating of the tow to facilitate the heating and drawing in a subsequent process. The fifth heating plate 1550, disposed between the fourth pair of drawing hot rollers 1900 and the fifth pair of drawing hot rollers 2000, further improves the consistency of the internal and external temperatures of the tow and improves the uniformity of heating of the tow to facilitate shaping and retraction in a subsequent process.

In some embodiments, as shown in FIG. 4, the feeding-splitting filament tension roller 1400 adopts a fixed cold roller 1410 cooperating with an angle-adjustable splitting filament roller 1420, while the first pair of drawing hot rollers 1600, the second pair of drawing hot rollers 1700, the third pair of drawing hot rollers 1800, the fourth pair of drawing hot rollers 1900 and the fifth pair of drawing hot rollers 2000 each adopt an angle-adjustable hot roller cooperating with an angle-adjustable hot roller.

The first pair of drawing hot rollers 1600 are the low-temperature rollers that preliminarily heat the tow, while the second pair of drawing hot rollers 1700, the third pair of drawing hot rollers 1800, the fourth pair of drawing hot rollers 1900, and the fifth pair of drawing hot rollers 2000 each are high-temperature roller, which further heats the tow to draw, slack and shape.

A draw ratio between the feeding-splitting filament tension roller 1400 and the first pair of drawing hot rollers 1600 is maintained at 1:(1.04-1.08), so that the tow maintains a certain tension. A draw multiple of the first pair of drawing hot rollers 1600 and the second pair of drawing hot rollers 1700 is 1.5 to 3.5 times, and this level of drawing is conducive to a high orientation of degree and a lower crystallinity. A draw multiple of the second pair of drawing hot rollers 1700 and the third pair of drawing hot rollers 1800 is 2.0 to 3.5 times to form a secondary heating and drawing; a draw multiple of the third pair of drawing hot rollers 1800 and the fourth pair of drawing hot rollers 1900 is generally 1.7 to 2.5 times to improve a uniformity and a draw multiple of the fiber, and to improve the strength of the tow. A draw multiple of the fourth pair of drawing hot rollers 1900 and the fifth pair of drawing hot rollers 2000 is 0.9-1.0 times, and there is a certain retraction of the fiber between the fourth pair of drawing hot rollers 1900 and the fifth pair of drawing hot rollers 2000, and therefore the tow drawn are shaped to eliminate a stress caused by a high-speed drawing. Therefore, a low shrinkage rate is better controlled.

A spinning-drawing-winding combined machine for industrial bio-based polyamide according to an embodiment is used to spin the industrial bio-based polyamide filament of 55 dtex-2222 dtex, including the industrial bio-based polyamide filament of 55 dtex-111 dtex, and the industrial bio-based polyamide filament of 1670 dtex-2222 dtex.

In some embodiments, the bio-based polyamide fiber tow, through a filament guider 1300, enters a filament path for turning and guiding filaments. The filament path is changed as 0°-90° and then the tow enters the feeding-splitting filament tension roller 1400 which adopts a combination of the fixed cold roller 1410 (φ (110-220)×400 mm) and the angle-adjustable splitting filament roller 1420 (φ (55-110)× 400 mm), and a surface of a roller shell is chromium oxide plus alumina. The tow after being turned by 90° moves vertically downward to tangentially contact a rear end of an effective area of a cylindrical surface of the fixed cold roller 1410, as shown in FIG. 4. Referring to FIG. 5. The tow is wound counterclockwise for half a circle from a left side of the cylindrical surface of the fixed cold roller 1410, and then pulled out tangentially from a right side of the cylindrical surface of the fixed cold roller 1410, and then enters a right side of a cylindrical surface of the angle-adjustable splitting filament roller 1420 and is wound for half a circle counterclockwise and then is pulled out tangentially from a left side of the cylindrical surface of the angle-adjustable splitting filament roller 1420 and then enters the left side of the cylindrical surface of the fixed cold roller 1410. At this moment, as the angle-adjustable splitting filament roller 1420 has a function of adjusting an angle and a front section of a cylindrical roller body of the angle adjustable splitting roller 1420 is inclined downward, and therefore the tow, wound half a circle on the cylindrical surface of the angle-adjustable splitting filament roller 1420, will have a certain movement of position on a surface of the roller body toward a front end of the roller body (as shown in FIG. 5). In this way, the tow is continuously wound counterclockwise between the fixed cold roller 1410 and the angle-adjustable splitting filament roller 1420 for 1 to 5 circles, and is pulled out counterclockwise from a lower tangent point of a front end of a cylindrical roller surface of the fixed cold roller 1410 after a last circle is completed. The winding on the feeding-splitting filament tension roller 1400 without heating is to hold a nascent tow and give the tow a certain speed. The tow is cooled and shaped under a pulling of the feeding-splitting filament tension roller 1400, and a spinning draw is completed to form nascent fibers. The tow enters the first heating plate 1510 at a speed of 550-750 m/min. At this moment, a surface of the tow in contact with the surface of the roller shell of the feeding-splitting filament tension roller 1400 is the N surface 20 of the tow, and the n tows are spread on the surface of the roller shell evenly, and in this way, a spinning tension can be increased to be enough to reduce a swing of a spun fiber. Since a speed ratio of the feeding-splitting filament tension roller 1400 and the first pair of drawing hot rollers 1600 is maintained as 1:(1.04-1.08), so that the tow is kept with a certain tension. It is required to preheat the tow to be drawn. The tow is pulled by the first pair of drawing hot rollers 1600, and passes through the first heating plate 1510. M surfaces 10 and the N surfaces 20 of the n tows each are heated in the first heating plate 1510.

When the industrial bio-based polyamide filament of 55 dtex-111 dtex is spun, a total denier and a single filament denier are all lower. The nascent fiber is prone to abnormal phenomena such as the end breakage during the initial drawing, and therefore, a heating environment with a relatively low temperature is required. As shown in FIG. 5, the n tows coming out of the feeding-splitting filament tension roller 1400 at a speed of 720 m/min pass through the first heating plate 1510. In the first heating plate 1510, the M surfaces 10 and the N surfaces 20 of the n tows are all heated. At this moment, a heating temperature is relatively low at 50-65° C., and a continuous low-temperature preheating is performed on the tow with a thinner cross-section, so that the inside of the tow is heated as much as possible in the heating plate to improve a penetration of heat. Then the n tows enter the first pair of drawing hot rollers 1600. The first pair of drawing hot rollers 1600 adopts an angle-adjustable hot roller plus an angle-adjustable hot roller. Shell surfaces of the first pair of drawing hot rollers 1600 are chromium oxide plus alumina. The first pair of drawing hot rollers 1600 in size are (2×φ (190-250)×(350-450) mm), and are the low-temperature rollers. The tow is wound on the roller surfaces of the first pair of drawing hot rollers 1600 for 6.5 to 7.5 circles, and a temperature of the first pair of drawing hot rollers 1600 is set as 75-100° C. In some embodiments, the temperature is 90° C., and a spinning speed is 700-800 m/min. The tow is spread stably on roller surfaces of the first pair of drawing hot rollers 1600, and wound counterclockwise for 6.5 to 7.5 circles on the roller surfaces of the first pair of drawing hot rollers 1600. At this moment, the surface of the tow heated on the surface of the roller shell is the N surface.

When the industrial bio-based polyamide filament of 1670 dtex-2222 dtex is spun, the total denier and the single filament denier are all higher. The nascent fiber is also prone to abnormal phenomena such as the end breakage during the initial drawing. At the same time, a poor spinnability during spinning, a too high bending strength of the tow and a hard hand-feeling will be caused due to the two high total denier and single filament denier. A heating environment with a relatively high temperature is required. As shown in FIG. 4 and FIG. 5, the n tows coming out of the feeding-splitting filament tension roller 1400 at a speed of 650 m/min pass through the first heating plate 1510. In the first heating plate 1510, the M surfaces 10 and the N surfaces 20 of the n tows each are heated. At this moment, a heating temperature is relatively low at 70-90° C., and a continuous relatively high-temperature preheating is performed on the tow with a thinner cross-section, so that the inside of the tow is heated as much as possible in the heating plate to improve a penetration of heat, and then the n tows enter the first pair of drawing hot rollers 1600. The first pair of drawing hot rollers 1600 adopts the angle-adjustable hot roller plus the angle-adjustable hot roller. Shell surfaces of the first pair of drawing hot rollers 1600 are chromium oxide plus alumina. The first pair of drawing hot rollers 1600 are (2×φ (190-250)×(350-450) mm) in size, and are the low-temperature rollers. The tow is wound on the roller surfaces of the first pair of drawing hot rollers 1600 for 6.5 to 7.5 circles, and a temperature of the first pair of drawing hot rollers 1600 is set as 75-100° C. In some embodiments, the temperature is 90° C., and a spinning speed is 700-800 m/min. The tow is spread stably on surfaces of the first pair of drawing hot rollers 1600, and wound for 6.5 to 7.5 circles on the roller surfaces of the first pair of drawing hot rollers 1600. At this moment, the surface of the tow heated on the surface of the roller shell is the N surface.

In some embodiments, as shown in FIG. 7 to FIG. 9, the tow after being wound on the first pair of drawing hot rollers 1600, is pulled out from a right roller of the first pair of drawing hot rollers 1600 and then transferred to the second heating plate 1520. In the second heating plate 1520, the M surfaces 10 and the N surfaces 20 of the n tows each are heated The n tows are evenly spread on a surface of a left roller of the second pair of drawing hot rollers 1700. At this moment, the surface of the tow heated on the surface of the roller shell is the M surface. The second pair of drawing hot rollers 1700 adopts the angle-adjustable hot roller plus the angle-adjustable hot roller. Shell surfaces of the second pair of drawing hot rollers 1700 are chromium oxide plus alumina. The second pair of drawing hot rollers 1700 are high-temperature rollers. The second pair of drawing hot rollers 1700 are (2×φ(190-250)×(350-450) mm) in size. The first pair of drawing hot rollers 1600 are the low-temperature rollers with a temperature set as 75-100° C., and the second pair of drawing hot rollers 1700 are the high-temperature rollers with a temperature set as 110-145° C., and therefore a temperature of the tow can be gradually and steadily increased, which is conducive to gradual orientation and crystallization of the fibers to achieve mechanical properties of the fibers of the industrial bio-based polyamide filament. The second heating plate 1520 is placed so that each filament passes between heaters individually and will be stably spread on the surfaces of the second pair of drawing hot rollers 1700, thereby improving the consistency between the internal and external temperatures of the tow and improving the uniformity of heating of the tow to facilitate the heating and drawing in the subsequent process. From the first pair of drawing hot rollers 1600 to the second pair of drawing hot rollers 1700, heated surfaces of the tow are reversed. At this moment, the surface of the tow heated on the surface of the roller shell is the M surface. The M surface of the tow is also heated during this process, and are further heated by the second heating plate 1520, and thus it is beneficial to improving the crystallinity and degree of orientation of the fiber, and the strength and modulus of the fiber can be gradually increased. The second heating plate 1520 is set with a temperature of 95-115° C. The tow, after passing through the second heating plate 1520, is transferred to the second pair of drawing hot rollers 1700. The tow is wound clockwise for 6.5 to 7.5 circles on the roller surfaces of the second pair of drawing hot rollers 1700, and the spinning speed is 1680 m/min. The draw multiple of the first pair of drawing hot rollers 1600 and the second pair of drawing hot rollers 1700 is generally 1.5 to 3.5 times. This level of drawing is to obtain a high orientation and a low crystallinity. When the industrial bio-based polyamide filament of 55 dtex-111 dtex is spun in comparation with the industrial bio-based polyamide filament of 1670 dtex-2222 dtex, the total denier and single filament denier are lower, a heated area is small, a heating environment of relative 5-10° C. lower is required, and the draw ratio is 5%-10% smaller since a filament is relatively thin.

In some embodiments, as shown in FIG. 10 to FIG. 12, the tow after being wound on on the second pair of drawing hot rollers 1700, is pulled by the third pair of drawing hot rollers 1800 and passes through the third heating plate 1530 in which all the M surfaces 10 and the N surfaces 20 of the n tows are heated. The tows are spread stably on surfaces of the third pair of drawing hot rollers 1800. The tows are wound for 6.5 to 7.5 circles on surfaces of two rollers of the third pair of drawing hot rollers 1800. The n tows are evenly spread on the surface of the roller shell. The surface of the tow heated on the surface of the roller shell is the N surface. Therefore, a certain degree of strength and elongation can be obtained at this level of drawing. When the industrial bio-based polyamide filament of 55 dtex-111 dtex is spun in comparation with the industrial bio-based polyamide filament of 1670 dtex-2222 dtex, the total denier and single filament denier are lower, a heated area is small, a heating environment of relative 5-15° C. lower is required. The draw ratio is 4%-12% smaller since a filament is relatively thin. The third heating plate 1530 is set with a temperature of 110-155° C. The tow, after passing through the third heating plate 1530, is transferred to the third pair of drawing hot rollers 1800. The third pair of drawing hot rollers 1800 adopts the angle-adjustable hot roller plus the angle-adjustable hot roller. Shell surfaces of the third pair of drawing hot rollers 1800 are chromium oxide plus alumina. The third pair of drawing hot rollers 1800 are (2×φ (190-250)×(350-450) mm) in size and are the high-temperature rollers, and the tow is wound on the roller surfaces of the third pair of drawing hot rollers 1800 for 6.5 to 7.5 circles, and a temperature of the third pair of drawing hot rollers 1800 is set as 130-150° C. In some embodiments the temperature is 140° C., a spinning speed is 2520 m/min. The draw multiple of the second pair of drawing hot rollers 1700 and the third pair of drawing hot rollers 1800 is 2.0 to 3.5 times to form a secondary heating and drawing. The temperature of the tow can be gradually and steadily increased, and the uniformity and draw multiple of the fiber are improved and the strength of the tow is improved. The third heating plate 1530 is placed so that each filament passes between heaters individually and will be stably spread on the surfaces of the third pair of drawing hot rollers 1800, thereby further improving the consistency between the internal and external temperatures of the tow and improving the uniformity of heating of the tow to facilitate the heating and drawing in the subsequent process. From the second pair of drawing hot rollers 1700 to the third pair of drawing hot rollers 1800, the heated surfaces of the tow are reversed again. At this moment, the surface of the tow heated on the surface of the roller shell is the N surface. Both surfaces of the tow are heated, and are further heated by the third heating plate 1530, and thus it is beneficial to improving the crystallinity and degree of orientation of the fiber, and the strength and modulus of the fiber can be gradually increased.

In some embodiments, as shown in FIG. 13 to FIG. 15, the tow after being wound on the third pair of drawing hot rollers 1800, the tow is pulled by the fourth pair of drawing hot rollers 1900 and passes through the fourth heating plate 1540 in which all the M surfaces 10 and the N surfaces 20 of the n tows are heated. The tows are spread stably on surfaces of the fourth pair of drawing hot rollers 1900. The tows are wound for 6.5 to 7.5 circles on surfaces of two rollers of the fourth pair of drawing hot rollers 1900. The n tows are evenly spread on the surface of the roller shell. At this moment, the surface of the tow heated on the surface of the roller shell is the M surface. This level of drawing is also to obtain a certain strength and elongation, and has a certain pre-shaping effect. When the industrial bio-based polyamide filament of 55 dtex-111 dtex is spun in comparation with the industrial bio-based polyamide filament of 1670 dtex-2222 dtex, and the total denier and single filament denier are lower, and a heated area is small, and a heating environment of relative 2-10° C. lower is required. The draw ratio is 2%-8% smaller since a filament is relatively thin. A temperature of the fourth heating plate 1540 is set as 125-195° C. A third heating and drawing is formed between the third pair of drawing hot rollers 1800 and the fourth pair of drawing hot rollers 1900. The draw multiple is generally 1.7~2.5 times. Therefore, the temperature of the tow can further be gradually and steadily increased, the uniformity and draw multiple of the fiber are improved and the strength of the tow is improved. The fourth heating plate 1540 is placed so that each filament passes between heaters individually and will be stably spread on the surfaces of the fourth pair of drawing hot rollers 1900, thereby further improving the consistency between the internal and external temperatures of the tow and improving the uniformity of heating of the tow to facilitate the heating and drawing in the subsequent process. From the third pair of drawing hot rollers 1800 to the fourth pair of drawing hot rollers 1900, the heated surfaces of the tow are reversed again, at this moment, the surface of the tow heated on the surface of the roller shell is the M surface. Both surfaces of the tow are heated, and are further heated by the fourth heating plate 1540, and thus it is conducive to an increase in the degree of orientation and a grain size of a crystallization zone and a perfection of the crystallization zone in a subsequent drawing. The tow, after passing through the fourth heating plate 1540, is transferred to the fourth pair of drawing hot rollers 1900. The fourth pair of drawing hot rollers 1900 adopts an angle-adjustable hot roller cooperating with an angle-adjustable hot roller, and a shell surface of the hot roller is ceramic. The fourth pair of drawing hot rollers 1900 are (2×φ(190-235)×(350-400) mm) in size, and are the high-temperature roller, and the temperature is set as 130-150° C. The tow is wound around 6.5 to 7.5 circles on the roller surface of the fourth pair of drawing hot rollers 1900, and a spinning speed is 3650 m/min.

In some embodiments, as shown in FIG. 16 to FIG. 18, the tow after being wound on the fourth pair of drawing hot rollers 1900, the tow is pulled by the fifth pair of drawing hot rollers 2000 and passes through the fifth heating plate 1550. A temperature of the fifth heating plate 1550 is set with 140-220° C. In the fifth heating plate 1550, the M surfaces 10 and the N surfaces 20 of the n tows each are heated. The tows are spread stably on surfaces of the fifth pair of drawing hot rollers 2000. The tows are wound for 6.5 to 7.5 circles on surfaces of two rollers of the fifth pair of drawing hot rollers 2000. The n tows are evenly spread on the surface of the roller shell. At this moment, the surface of the tow heated on the surface of the roller shell is the M surface. This level plays a role in slacking and shaping. When the industrial bio-based polyamide filament of 55 dtex-111 dtex is spun in comparation with the industrial bio-based polyamide filament of 1670 dtex-2222 dtex, the total denier and single filament denier are lower, a heated area is small, a heating environment of relative 1-4° C. lower is required, and a slack ratio is 1%-3% smaller since a filament is relatively thin. The draw multiple of the fourth pair of drawing hot rollers 1900 and the fifth pair of drawing hot rollers 2000 is generally 0.9-1.0 times. A speed of the fifth pair of drawing hot rollers 2000 is slightly lower than that of the fourth pair of drawing hot rollers, and therefore there is a certain amount of retraction of the fibers between the fourth pair of drawing hot rollers 1900 and the fifth pair of drawing hot rollers 2000 to complete a shaping of high-strength filaments, and therefore a main function of shaping drawn tows is achieved and a stress of the fibers caused by a high-speed drawing is eliminated. Therefore, a low shrinkage rate is better controlled. The fifth heating plate 1550 is placed so that each filament passes between heaters individually and will be stably spread on the surfaces of the fifth pair of drawing hot rollers 2000, thereby further improving the consistency between the internal and external temperatures of the tow and improving the uniformity of heating of the tow to facilitate the shaping and retraction in the subsequent process. The tow, after passing through the fifth heating plate 1550, is transferred to the fifth pair of drawing hot rollers 2000. The fifth pair of drawing hot rollers 2000 adopts the angle-adjustable hot roller plus the angle-adjustable hot roller, and a shell surface of the hot roller is ceramic. The fifth pair of drawing hot rollers 2000 are (2×φ (190-220)×(350-400) mm) in size, and are the high-temperature roller. The tow is wound around 6.5 to 7.5 circles on the roller surfaces of the fifth pair of drawing hot rollers 2000 and a temperature of the fifth pair of drawing hot rollers 2000 is set as 130-210° C. and a spinning speed is 3550 m/min.

In some embodiments, the combined machine is used for spinning a fine denier bio-based polyamide fiber of 55 dtex-111 dtex, a coarse denier bio-based polyamide fiber of 1670 dtex-2222 dtex, and can also be used for spinning a bio-based polyamide fiber of 111 dtex-1670 dtex.

Embodiment Three

The spinning-drawing-winding combined machine for industrial bio-based polyamide disclosed in the Embodiment Two involves a first heating plate 1510, a second heating plate 1520, a third heating plate 1530, a fourth heating plate 1540 and a fifth heating plate. Heating plate 1550. In some embodiments, as shown in FIGS. 19 to 21, the heating plate may include a heat transfer block 1501 and a plurality of heating rods 1502. The heat transfer block 1501 is provided with an opening slot 1503 for the tow to pass through. The plurality of heating rods 1502 (three are three heating rods shown in the figures, the number is variable) are arranged in sequence along a length direction of the opening slot 1503. The heating rods 1502 are arranged in a shape of hook shape which is formed with a hook portion and a hook groove. The hook portion is disposed within the heat transfer block 1501, and the hook groove is for the tow to pass through. Both sides of the tow passing though can be fully and evenly heated by the heating plate.

Embodiment Four

The combined spinning-drawing-winding machine for industrial bio-based polyamide disclosed in Embodiment Two involves a screw extruder which is equipped with an extruder screw. Referring to FIG. 22 to FIG. 25, this embodiment provides an extruder screw, including a screw feed section 110, a screw compression section 120 and a screw metering section 130. An end of the screw feed section 110 is detachably connected to an end of the screw compression section 120, and another end of the screw compression section 120 is detachably connected to an end of the screw metering section 130.

The extruder screw adopts a three-section arrangement of the screw feed section 110, the screw compression section 120 and the screw metering section 130, and the two adjacent sections are detachably connected. In the problems on screw corrosion and a gradually larger dimensional tolerance between a screw sleeve and a screw rod caused due to an instability of bio-based polyamide raw materials, for a metering section that may be first worn, the screw metering section 130 can be regularly replaced. Such replacement is convenient to ensure yield and efficiency of the screw extruder.

Similarly, the screw compression section 120 and the screw feed section 110 can also be replaced regularly.

Figure 22:
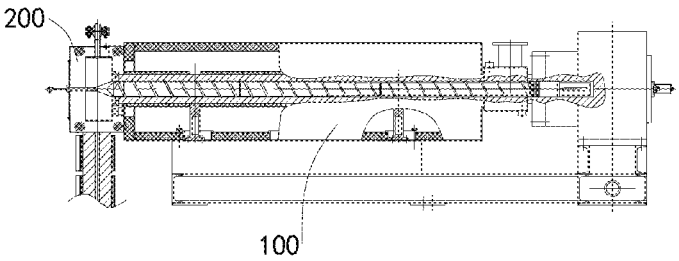
FIG. 22 is a structural schematic diagram of a screw extruder in FIG. 2.

In some embodiments, as shown in FIG. 22, the extruder screw is mounted at the screw extruder 100, and the screw extruder 100 is equipped with an extrusion head 200, through which a melt is delivered into a subsequent melt pipe.

In some embodiments, the screw metering section 130 may also include a mixing head 140. The mixing head 140 is disposed at a position of a head of the screw rod to improve an effect of the extruder screw stirring and homogenizing the melt.

In some embodiments, as shown in FIG. 22, an end of the screw feed section 110 away from the screw compression section 120 is also connected with a key connector 150 for connecting to a transmission mechanism through the key connector 150 to drive the screw rod to rotate into a working state.

In some embodiments, the extrusion head 200 may include a pressure sensor that detects a pressure value of a melt, so that the pressure value of the melt may be detected to ensure that a head pressure of the screw extruder 100 is constant.

In some embodiments, the extrusion head 200 may include a temperature sensor that detects a temperature of a melt to measure online temperature parameters of the melt, such as a biomass polyamide melt, to facilitate an overall spinning process.

In some embodiments, the extrusion head 200 is disposed with a pre-filter ring (not shown in figures) in a melt channel. Materials with larger particles are filtered through the pre-filter ring to ensure a quality of the melt that enters subsequent melt pipe.

In some embodiments, a detachable connection in the above solution may include a threaded connection. Both ends of the screw compression section 120 are threadedly connected to an end of the screw feed section 110 and an end of the screw metering section 130 respectively. The detachable connection facilitates more frequent replacement of the screw metering section 130 rapidly worn, thereby ensuring the yield and efficiency of the screw extruder 100.

In some embodiments, pin connections can also be adopted in solutions of a threaded connection between two sections to improve a connection quality. In some embodiments, the detachable connection between the screw compression section 120 and the screw feed section 110 is taken as an example, referring to FIG. 23 and FIG. 24.

Figure 23:
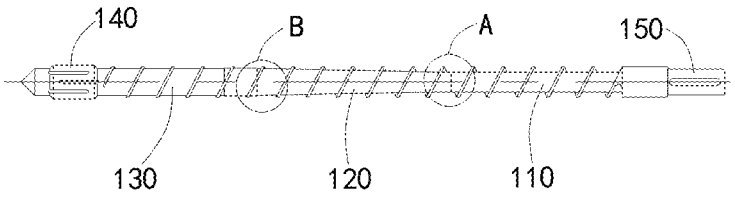
FIG. 23 is a structural schematic diagram of an extruder screw in FIG. 22.
Figure 24:
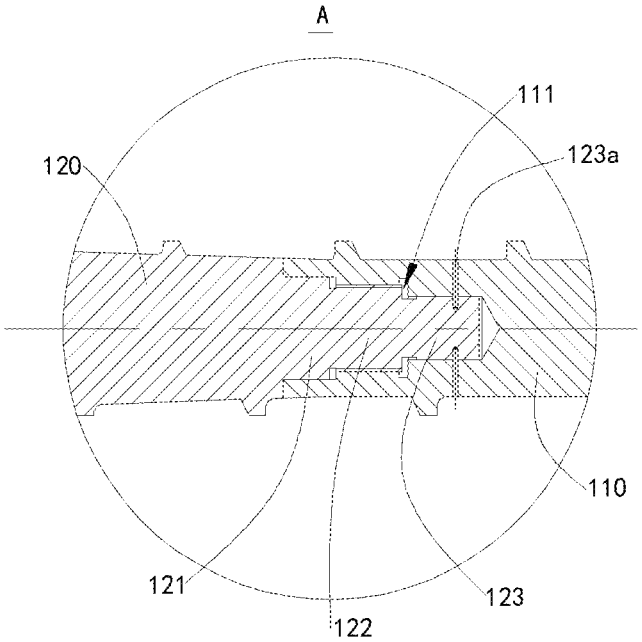
FIG. 24 is a partially enlarged view of a portion indicated by A in FIG. 23.

Referring to FIG. 23 and FIG. 24, an end of the screw compression section 120 close to the screw feed section 110 includes a first protrusion 121, a second protrusion 122 and a third protrusion 123 connected in sequence. Axes of the first protrusion 121, the second protrusion 122 and the third protrusion 123 coincide with one another. Radial lengths of the first protrusion 121, the second protrusion 122 and the third protrusion 123 decrease successively. An outer circumferential surface of the second protrusion 122 is provided with a first thread. An end of the screw feed section 110 close to the screw compression section 120 is provided with a first shaft hole 111. The first protrusion 121, the second protrusion 122 and the third protrusion 123 sequentially penetrate into the first shaft hole 111. An inner wall of the first shaft hole 111 of the screw feed section 110 is disposed with a second thread (not shown in the drawings) connected with the first thread. The third protrusion 123 is pinned to the screw feed section 110 through a first positioning pin 123*a*. A pin hole corresponding to the first positioning pin 123*a*, is radially opened and distributed in the third protrusion and the screw feed section 110.

By an arrangement of three protrusions, a thickness of a barrel wall of the screw feed section 110 at the pin connection is made to be larger to cooperate with the third protrusion 123 to improve a stability of the pin connection. The second protrusion 122 is disposed between the first protrusion 121 and the third protrusion 123, as shown in FIG. 24, and an outer circumferential surface of the first protrusion 121 is configured to closely fit with an inner wall of the first shaft hole 111 of the screw feed section 110, so that the first thread and the second thread in the middle are separated from an outer space area of the screw rod.

Figure 25:
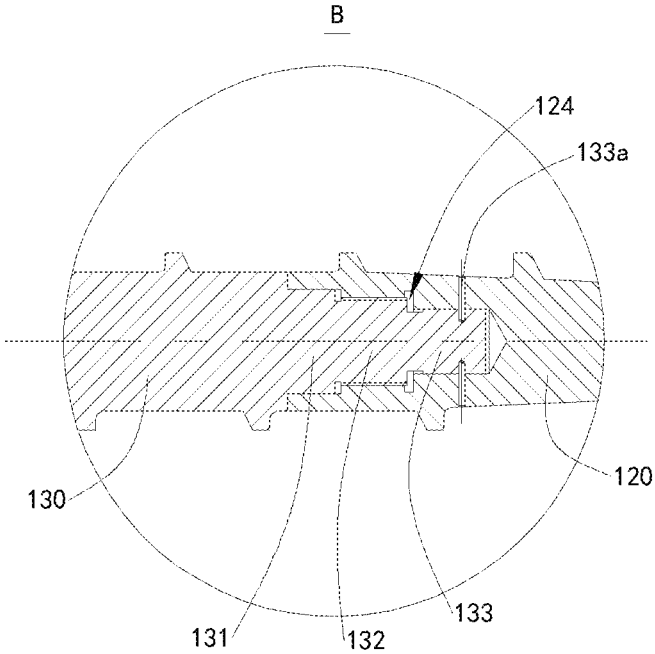
FIG. 25 is an enlarged schematic diagram of a portion indicated by B in FIG. 23.

Similarly, in a solution of the detachable connection between the screw compression section 120 and the screw metering section 130, referring to FIGS. 23 and 25, an end of the screw metering section 130 close to the screw compression section 120 includes a fourth protrusion 131, a fifth protrusion 132 and a sixth protrusion 133 connected in sequence. Axes of the fourth protrusion 131, the fifth protrusion 132 and the sixth protrusion 133 coincide with one another. Radial lengths of the fourth protrusion 131, the fifth protrusion 132 and the sixth protrusion 133 decrease successively. An outer circumferential surface of the fifth protrusion 132 is provided with a third thread. An end of the screw compression section 120 close to the screw metering section 130 is disposed with a second shaft hole 124. The fourth protrusion 131, the fifth protrusion 132 and the sixth protrusion 133 sequentially penetrate into the first shaft hole 124. An inner wall of the second shaft hole 124 of the screw feed section 120 is disposed with a fourth thread connected with the third thread. The sixth protrusion 133 is pinned to the screw compression section 120 through a second positioning pin 133*a*. The sixth protrusion 133 and the screw compression section 120 are disposed with a radially distributed pin hole in correspondence with the second positioning pin 133*a*.

In other possible embodiments, the detachable connection between the screw compression section 120 and the screw feed section 110 and the detachable connection between the screw compression section 120 and the screw metering section 130 can also be accomplished by a way of threaded connection cooperating with a screw connection, a snapping and so on.

In some embodiments, an aspect ratio of the screw rod of the extruder screw may be controlled as (25-32):1.

Embodiment Five

The combined spinning-drawing-winding machine for industrial bio-based polyamide disclosed in Embodiment Two or Embodiment Four involves a melt pipe. Referring to FIG. 26 to FIG. 29, this embodiment discloses a melt pipe 300. The melt pipe 300 cooperates with the screw extruder 100 and the spinning box 400. The melt pipe 300 may include a melt main pipe 310, a plurality of melt branch pipes 320, a plurality of delivery pumps 330 and a pressure-measuring element for melt in melt pipe 340. An end of the melt main pipe 310 is connected to the screw extruder 100. An end of each of the plurality of melt branch pipes 320 is in communication with another end of the melt main pipe 310. Further ends of the plurality of melt branch pipes 320 are connected to the plurality of spinning boxes 400 in one-to-one relationship. The plurality of delivery pumps 330 are mounted at the plurality of melt branch pipes 320 in one-to-one relationship. The pressure-measuring element for melt in melt pipe 340 is mounted at the melt main pipe 310. In some embodiments, the spinning boxes 400 each are equipped with a pressure-measuring element for melt in spinning-box 413, and the pressure-measuring element for melt in melt pipe 340 and the pressure-measuring element for melt in spinning-box 413 are both connected to an electrical frequency converter for assisting the electrical frequency converter to regulate the delivery pumps 330.

Figure 26:
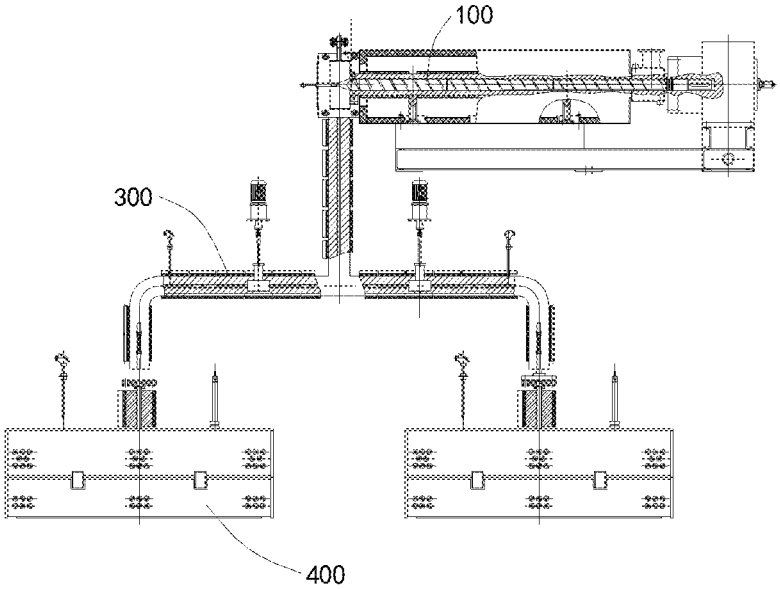
FIG. 26 is a structural schematic diagram of the screw extruder, a melt pipe and a spinning box in FIG. 2.
Figure 27:
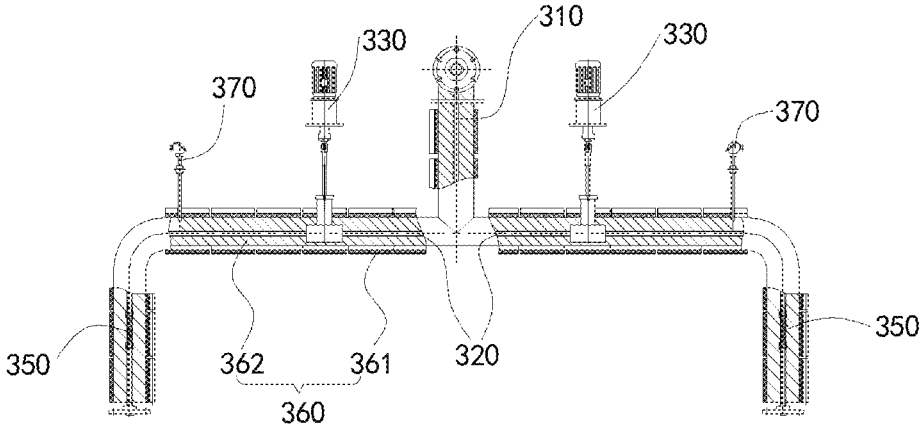
FIG. 27 is a front view of the melt pipe in FIG. 26.

The above-mentioned screw extruder 100, the melt pipe 300 and the spinning box 400 are connected in sequence. A melt transported from the screw extruder 100 to the melt main pipe 310 is delivered to the plurality of melt branch pipes 320 and then enters the spinning box 400. Referring to FIG. 26 and FIG. 27, a delivery pump 330 is provided in the melt branch pipe 320 to pump the melt.

The melt main pipe 310 is equipped with the pressure-measuring element for melt in melt pipe 340 for detecting a pressure value of a melt when flowing through the melt main pipe 310. The pressure-measuring element for melt in spinning-box 413 is disposed in the spinning box 400, and can detect a pressure value of a melt when flowing through the spinning box 400, and each spinning box 400 is provided with the pressure-measuring element for melt in spinning-box 413. Through detection data from the pressure-measuring element for melt in melt pipe 340 and the pressure-measuring element for melt in spinning-box 413, a pressure drop data of the melt from the melt branch pipe 320 to various spinning boxes 400 is obtained, and in turn under a real-time feedback, the electrical frequency converter regulates the delivery pump 330 by utilizing the pressure drop data to accurately distribute the melt passing through the melt branch pipe 320 to ensure that the pressure drop of each melt branch pipe 320 is equal, so that the melt can be ensured to be delivered to a pump inlet of each spinning position with an equal pressure drop.

It can be understood that when the pressure drop is consistent, it is also ensured that the melt is delivered to the pump inlet of each spinning position with equal residence time. As for the pressure drop being consistent, it can also be understood that pressure states of the plurality of melt branch pipes 320 are controlled to be substantively consistent, thereby ensuring that a flow rate of each melt branch pipe 320 is also equal.

In summary, a residence time, a temperature, a shear rate and a pressure distribution of the melt reaching each spinning position can be made uniform through the melt pipe 300 of this embodiment cooperating with a detection of the pressure of melt in the spinning box 400, which is beneficial to controlling a spinning quality and a spinning speed of each spinning box 400, and in turn controlling different spinning positions to be in a same spinning state.

Figure 28:
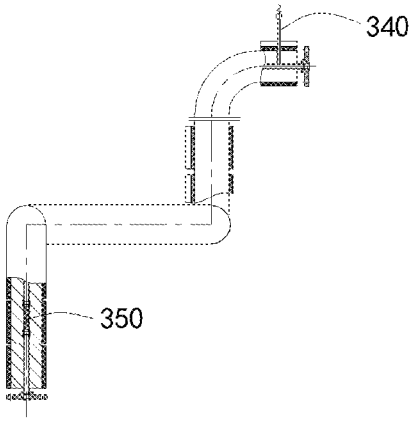
FIG. 28 is a side view of the melt pipe in FIG. 26.

In some embodiments, as shown in FIG. 27 and FIG. 28, the melt pipe 300 may include a plurality of static mixers 350. The multiple static mixers 350 are disposed in one-to-one relationship in the melt branch pipes 320, and close to the spinning box 400. After the melt is thoroughly mixed by the static mixer 350, the melt is delivered to the spinning box 400.

In some embodiments, as shown in FIG. 27, the melt pipe 300 includes a melt-pipe heater assembly 360 and a plurality of melt-pipe temperature measuring element 370. The melt-pipe heater assembly 360 is mounted in the melt main pipe 310 and the melt branch pipe 320. The plurality of melt-pipe temperature measuring elements 370 are mounted at the plurality of melt branch pipes 320 in one-to-one relationship to detect a temperature of the melt flowing through the melt branch pipe 320. The filament is ensured within a preset temperature range through a relevant heating, and an auxiliary control of detecting the temperature.

In some embodiments, as shown in FIG. 27, the melt-pipe heater assembly 360 includes a plurality of melt-pipe electrical heaters 361 and a melt-pipe metal filler 362. The plurality of melt-pipe electrical heaters 361 surround the main pipe 310 and the melt branch pipe 320. The melt-pipe metal filler 362 is disposed between the melt-pipe electrical heater 361 and a cavity wall of a melt-pipe cavity of the melt main pipe 310, and is disposed between the melt-pipe electrical heater 361 and a cavity wall of a melt-pipe cavity of the melt branch pipe 320.

Figure 29:
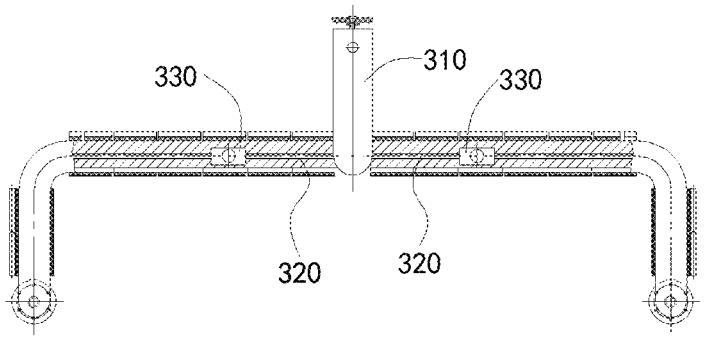
FIG. 29 is a top view of the melt pipe in FIG. 26.

The melt-pipe electrical heater 361 surround the melt main pipe 310 and the melt branch pipe 320. The melt-pipe electrical heater 361 is disposed in an annular shape and arranged along an outer circumference of a pipe cavity of a pipe body of the melt pipe 300 to heat the melt fully circumferentially. Moreover, the melt-pipe metal filler 362 acts as a heat equalizing block for achieving uniform and sufficient heating of the melt and plays a certain role in heat preservation. The melt-pipe metal filler 362 may include a copper powder, an iron powder, an aluminum powder and so on As shown in FIG. 27 to FIG. 29, the above-mentioned melt-pipe electrical heater 361 may be a heating ring. In some embodiments, a plurality of heating rings are disposed along an extension direction of a pipe body of the melt main pipe 310 at an interval, and a plurality heating rings are disposed along an extension direction of a pipe body of the melt branch pipe 320 at an interval.

The melt pipe 300 in some embodiment includes a plurality of melt branch pipes 320. Two melt branch pipes 320 are shown in FIG. 27 to FIG. 29, however three, four or more melt branch pipes 320 are applicable.

Embodiment Six

The combined spinning-drawing-winding machine for industrial bio-based polyamide disclosed in Embodiment Two, Embodiment Four or Embodiment Five involves a spinning box that cooperates with the melt pipe 300. As shown in FIG. 26 and FIG. 30 to FIG. 32, the spinning box 400 includes an upper box 410, a lower box 420, a metering pump 500, a detachable pump base 483, a spinning assembly 600, a box pipe 430, an upper-box heater assembly 440 and a lower-box heater assembly 450. The lower box 420 is fixedly connected to the upper box 410. The metering pump 500 is mounted at the detachable pump base 483. The metering pump 500 and the detachable pump base 483 are both disposed within the upper box 410. The spinning assembly 600 is disposed within the lower box 420. The box pipe 430 is used for communicating the melt pipe 300 to the detachable pump base 483 and communicating the detachable pump base 483 to the spinning assembly 600. The upper-box heater assembly 440 is disposed at the upper box, and the lower-box heater assembly 450 is disposed at the lower box.

In some embodiments, the box pipe 430 is used for communicating the melt pipe 300 to the detachable pump base 483 and communicating the detachable pump base 483 to the spinning assembly 600. The metering pump 500 is mounted at the detachable pump base 483. The melt is delivered from the melt pipe 300 along a portion of the box pipe 430 into the detachable pump base 483. The detachable pump base 483 is therein disposed with a channel, and the channel returns into the pump base after passing through the metering pump and have an opening at another position to deliver the melt into the spinning assembly 600 along another portion of the box pipe 430.

In some embodiments, the metering pump 500 is also connected to a transmission mechanism.

Figure 32:
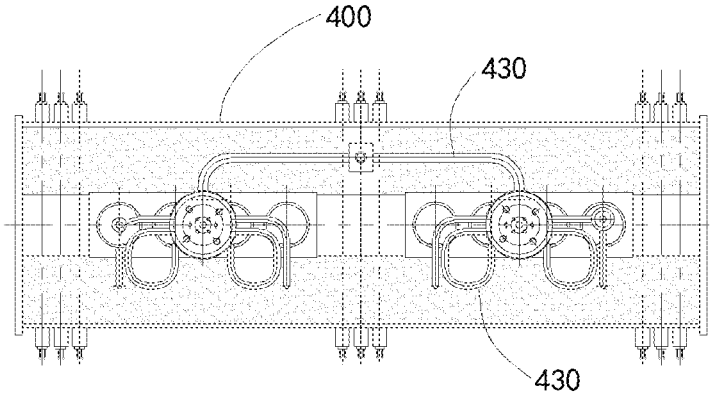
FIG. 32 is a horizontal sectional view of the spinning box in FIG. 26.

In some embodiments, the spinning box 400 is disposed with a plurality of spinning assemblies 600. The box pipe 430 partially passes through the detachable pump base 483 and each spinning assembly 600. Various portions passing through the detachable pump base 483 and each spinning assembly 600 of the box pipe can be configured to be consistent in length, such as by a way of coiling as shown in FIG. 32 and so on, thereby being beneficial to evenly distribute the melt.

In some embodiments, the spinning box 400 is configured as a double-layer structure including an upper box 410 and a lower box 420 that are fixed to one another, and elements are disposed accordingly, thereby being beneficial to reduce a volume and facilitating hoisting and calcination treatment. On the other hand, the spinning box 400 is configured as 1-position/box structure with a smaller volume. When a pipeline is caused to gradually become blocked because of frequent degradation and carbonization caused due to the instability of the bio-based polyamide raw materials and needs to be dismantled and calcined, the small volume and the double-layer structure including the upper box 410 and the lower box 420 can facilitate processing in an ordinary calcining furnace, thereby avoiding a disadvantageous situation of requiring a special large-scale calcining device.

Figure 31:
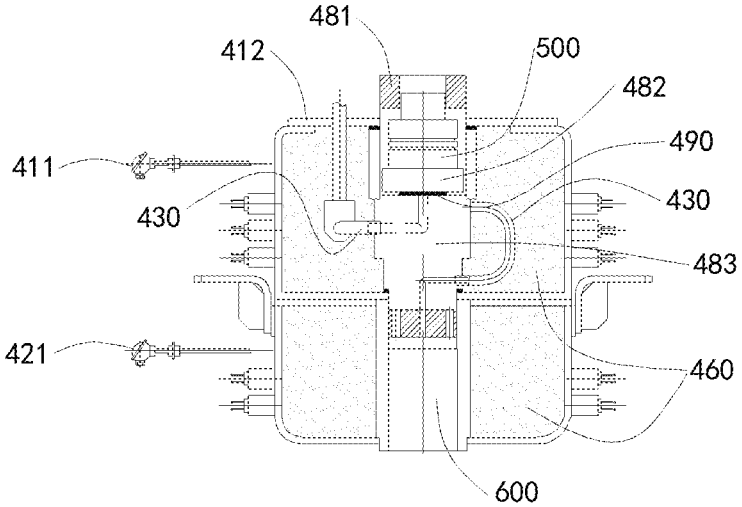
FIG. 31 is a vertical sectional view of the spinning box in FIG. 26.

In some embodiments, as shown in FIG. 31, the metering pump 500 is located in the upper box 410, and the spinning assembly 600 is located in the lower box 420. The upper box 410 and the lower box 420 can be heated by different heaters, and thus temperatures in the upper box 410 and in the lower box 420 can be adjusted separately, and in particular the temperature of the lower box 420 can be controlled to be higher, so that the spinning assembly 600 is at a higher temperature, which is beneficial to an output of filament for a spinneret of the spinning assembly 600, and the spinning speed and the spinning quality can be improved.

In some embodiments, the melt is continuously and accurately supplied to the spinning assembly 600 for spinning the filament through the metering pump 500 with high pressure. Because the metering pump 500 requires a metering accuracy with high-precision, a transmission shaft of transmission components for the metering pump is driven by a permanent magnet synchronous motor directly coupled with a cycloid pinion reducer through a frequency control of speed. Electrical transmission components of various metering pumps are independently driven. The transmission shaft can be telescopic, and is equipped with a universal spindle coupling and a safety-pin protection device. Therefore, the melt is ensured to be delivered to each spinning position with equal residence time and enters the spinning assembly 600 in sequence.

In some embodiments, as shown in FIG. 31, the spinning box 400 may further include a spinning-box metal filler 460 which is respectively disposed within the upper box 410 and the lower box 420.

A heater in cooperation with the spinning-box metal filler 460 can play a heating role, and metal fillers, such as a copper powder, an aluminum powder, an iron powder and so on, are used to transfer heat and maintain heat. Therefore, compared with a conventional way that a heat is transferred by a biphenyl steam, it is conducive to the environmental protection and a pressure vessel design of the shell of the spinning box 400 can be avoided, and an operational safety can be improved and processing and use costs can be reduced.

In some embodiments, the above heaters may be a heating rod with a way of electric heating.

Figure 30:
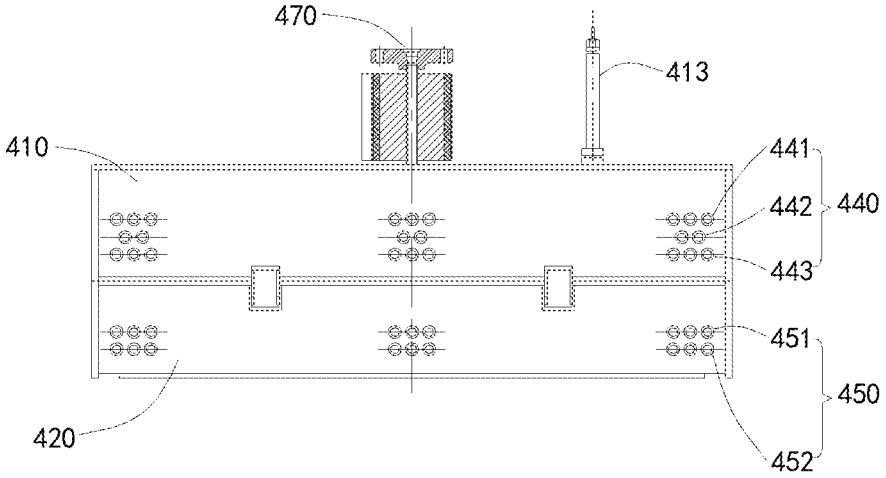
FIG. 30 is a front view of the spinning box in FIG. 26.

In some embodiments, referring to FIG. 30 and FIG. 31 in conjunction, the upper-box heater assembly 440 includes an upper-box basic heater 441, an upper-box auxiliary heater 442 and an upper-box adjustment heater 443. The lower-box heater assembly 450 includes a lower-box basic heater 451 and a lower-box adjustment heater 452.

With the above-designed the upper-box heater assembly 440 and the lower-box heater assembly 450, different heating modes can be adopted according to different situations. The upper-box basic heater 441, the upper-box auxiliary heater 442, the upper-box adjustment heater 443, the lower-box basic heater 451 and the lower-box adjustment heater 452 are not only individually controlled but also interrelated, and can be heated individually or in groups or wholly. The use of an intelligent temperature control system is conducive to reducing energy consumption and environmental protection. By cooperating the intelligent temperature control system with a variety of heaters, the problem that a high temperature will accelerate the carbonization of the bio-based polyamide fibers is not only be considered, but also a higher temperature is provided for the spinning assembly 600 to facilitate the output of filament, and a rapid temperature rising mode is provided.

For example, when the temperature is relatively low, such as when the spinning box 400 is just put into operation, the upper-box basic heater 441, the upper-box auxiliary heater 442 and the upper-box adjustment heater 443 may be fully turned on, and the lower-box basic heater 451 and the lower-box adjustment heater 452 may be fully turned on. For the lower box 420, the lower-box adjustment heater 452 is subsequently turned off, and the lower-box basic heater 451 is in working condition. For the upper box 410, the upper-box adjustment heater 443 is subsequently turned off, and then the upper-box auxiliary heater 442 is turned off.

In some embodiments, gaps among all parts in the spinning box 400 are filled with the metal fillers to transfer the heat and maintain the heat. In some embodiments, the upper box 410 includes an upper-box temperature measuring element 411, and the lower box 420 includes a lower-box temperature measuring element 421 for respectively detecting the spinning-box metal filler 460 in the upper box 410 and the spinning-box metal filler 460 in the lower box 420, and in turn a feedback data can be provided timely to assist in adjusting a power of the heater so as to achieve an intelligent temperature control with a temperature control accuracy of ±1° C.

In some embodiments, the upper box 410 includes an upper-box 410 body and an upper-box cover 412 detachably mounted at a top of the upper-box 410 body. By providing a detachable upper-box cover 412, when the pipeline is gradually blocked, the upper box cover 412 can be opened for disassembly and inspection.

In some embodiments, as shown in FIG. 31, the spinning box 400 includes a metering-pump insulation block 481. The metering-pump insulation block 481 is disposed between the metering pump 500 and the upper-box cover 412, encloses the metering pump 500, and improves a thermal insulation effect of the metering pump 500.

In some embodiments, a thermal insulation cover made of thermal insulation material is provided outside the spinning box 400 to improve an overall thermal insulation effect.

In some embodiments, as shown in FIG. 30, the spinning box 400 includes an upper-box melt inlet 470, and the melt pipe 300 is connected to the upper-box melt inlet 470, thereby providing a connection location for the melt pipe 300.

In some embodiments, the parts in the spinning box 400 are mostly modularly assembled and detachable to facilitate the processing in the ordinary calcining furnace.

In some embodiments, as shown in FIG. 31, the spinning box 400 includes a pump plate 482 and a detachable pump base 483. The metering pump 500 is mounted at a pump plate 482, and the pump plate 482 is mounted at the detachable pump base 483. The detachable pump base 483 is disposed within the upper box 410.

In some embodiments, as shown in FIG. 31, a component mounting plate is fixed below the detachable pump base 483 to connect to the spinning assembly 600.

In some embodiments, the spinning box 400 includes a sealing gasket 490 to seal sites of the spinning box 400 where the melt is prone to overflow.

In some embodiments, the spinning box 400 includes a pressure-measuring element for melt in spinning-box 413 mounted at the upper box 410. During production and spinning of a bio-based polyamide, a starting pressure at the spinning assembly 600 is generally greater than 10 MPa, and the pressure-measuring element for melt in spinning-box 413 provides a data support for a normal spinning.

In some embodiments, the spinning box 400, when used in the production and spinning of the bio-based polyamide, is set as 268° C. to 275° C. in temperature. The bio-based polyamide raw material melted in the screw extruder, after passing through the melt pipe 300 and entering the spinning box 400, is distributed into the box pipe 430, and further reaches the metering pump 500. Each spinning position is equipped with one or more metering pump(s) 500.

Embodiment Seven

The combined spinning-drawing-winding machine for industrial bio-based polyamide disclosed in Embodiment Two, Embodiment Four, Embodiment Five or Embodiment Six involves a monomer suction mechanism 800. Referring to FIG. 33 to FIG. 37. This embodiment provides a monomer suction mechanism 800 to perform a suction processing of a monomer on the tow coming out of the spinning assembly 600. In some embodiments, a heat-retarder 700 is disposed between the spinning assembly 600 and the monomer suction mechanisms 800, and injects a superheated steam onto the tow coming out of the spinning assembly 600 to form a hot steam containing the monomer. The hot steam containing the monomer is further processed by the monomer suction mechanisms 800.

In some embodiments, the monomer suction mechanism 800 may include a suction body 810, a suction assembly 820 and a plurality of rectification heating plates 830. The suction body 810 is disposed with a body channel 811 leading to a spinneret of the spinning assembly. The suction assembly 820 includes a suction pipe 821, a vacuum pump 822, a compressed air pipe 823 and a heating coil 824. The suction pipe 821 is in communication with the body channel 811, and the vacuum pump 822 is disposed at the suction pipe 821. An end of the compressed air pipe 823 is used to introduce a compressed air, and another end of the compressed air pipe 823 extends into the suction pipe 821 and is placed between the suction body 810 and the vacuum pump 822. The heating coil 824 surrounds the suction pipe 821 and is disposed between the suction body 810 and the compressed air pipe 823. A plurality of rectification heating plates 830 are arranged in the body channel 811 at an interval, and form a rectifying channel in the body channel 811 that leads to the suction pipe 821. The hot steam containing the monomer is sucked into the suction pipe 821 under a negative pressure through the rectifying channel, and is discharged from another end of the suction pipe 821.

The heat-retarder 700 injects the superheated steam to the spinneret of the spinning assembly 600. When the monomer and an oligomer escape from a spinneret orifice with the melt at high temperature, a protective layer of superheated steam is formed on a surface of the spinneret. The superheated steam forms a cloud with a floating matter of monomer to avoid adhering to the surface of the spinneret, thereby ameliorating a disadvantageous situation of the spinneret orifice being blocked.

A hot air containing the monomer is extracted from the suction pipe 821 under the negative pressure along the body channel 811 of the suction body 810. In some embodiments, when the compressed air pipe 823 introduces the compressed air into the suction pipe 821, a negative pressure zone is formed within the suction pipe 821. On the basis of several rectifying channels formed by the rectification heating plate 830 and the suction body 810, the hot air containing the monomer is evenly sucked into the suction pipe 821 along the rectifying channels, and the rectifying channels are also advantageous for the monomer to enter the suction pipe 821 quickly and to be further discharged from another end of the suction pipe 821 through the vacuum pump 822.

In some embodiments, the suction pipe 821 between the suction body 810 and the compressed air pipe 823 is disposed with a heating coil 824 to maintain the hot air containing the monomer at a state of dry hot air to ameliorate an adversely affect that a fiber strength is affected by the end breakage caused by a generation of water steam due to a cooling of the hot air containing the monomer. The heating coil 824 may be further equipped with an additional electrical control box for an electrical control. The heating coil 824 can also maintain a certain temperature in this section of pipe to avoid residual monomer from crystallizing to clog the pipe which affects a suction effect of negative pressure.

On the other hand, the rectification heating plate 830 has a function of heating, and is advantageous for the hot air containing the monomer to maintain the state of dry hot air while traveling along the body channel 811 to the suction pipe 821.

With the monomer suction mechanism 800 of this embodiment cooperating with the spinning assembly 600, the monomer can be removed in time during the production of the bio-based polyamide filament, and the defects caused by the monomer, such as a blockage, a reduced strength of the tow, and broken ends, can be ameliorated. A strength of the tow, an evenness of filament levelness, a dyeing performance and so on can be ensured to guarantee a normal production.

Figure 33:
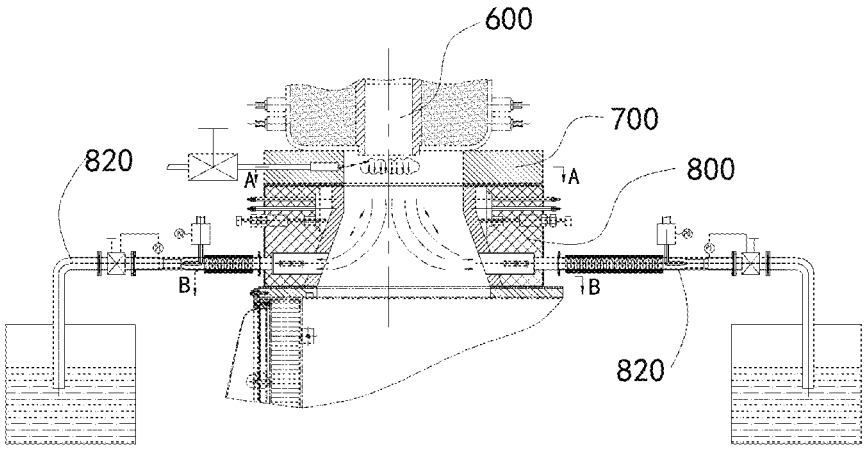
FIG. 33 is a structural schematic diagram of a spinning assembly, a heat-retarder and a monomer suction mechanism in FIG. 2.
Figure 34:
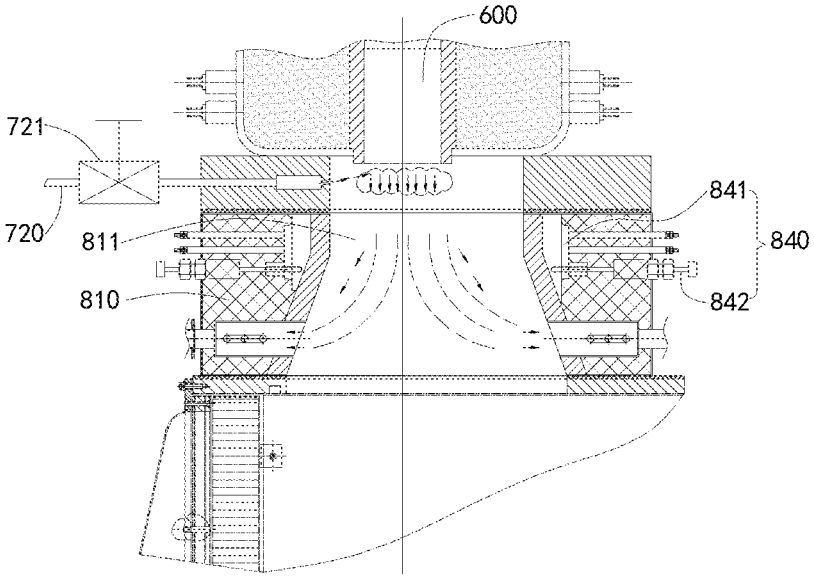
FIG. 34 is a partial structural schematic diagram of structures in FIG. 33.

In some embodiments, as shown in FIG. 33 and FIG. 34, the monomer suction mechanism 800 includes a transition heater 840 mounted in the suction body 810 and disposed between the heat-retarder 700 and the suction assembly 820. The transition heater 840 is provided at an outer periphery of the body channel 811. The superheated steam is injected to the spinneret through the heat-retarder 700 to form the hot air containing the monomer, and until the hot air containing the monomer enters the suction pipe 821, the hot air containing the monomer needs to go through a path, thus a transition heater 840 is provided to make the hot air containing the monomer continually maintain the state of dry hot air. It is not only conductive to avoiding a disadvantageous situation of end breakage caused by water steam dripping, but also making the tow to be temporarily maintained in the hot environment for a period of time without rapid cooling, and therefore an entanglement of macromolecular bonds due to a sudden cooling of a bio-based polyamide melt is prevented, and it is advantageous to ensure the strength of the tow.

In some embodiments, a thermal space environment of 180° C. to 240° C. is provided by the transition heater 840.

In some embodiments, as shown in FIG. 34, the transition heater 840 includes a plurality of plate heaters 841 disposed to be enclosed together to form the body channel 811 and a plate temperature measuring element 842 fixed within the suction body 810. The plate heaters 841 are fixedly disposed within the suction body 810, and the plate temperature measuring element 842 is used to detect a temperature of the body channel 811 at the plate heaters 841. As shown in a cross-section in FIG. 34, one plate heater 841 is provided on both vertical sides of the body channel 811 respectively. In some embodiments, the plate heater 841 may be provided in the form of a straight plate, a curved plate and so on.

Figure 37:
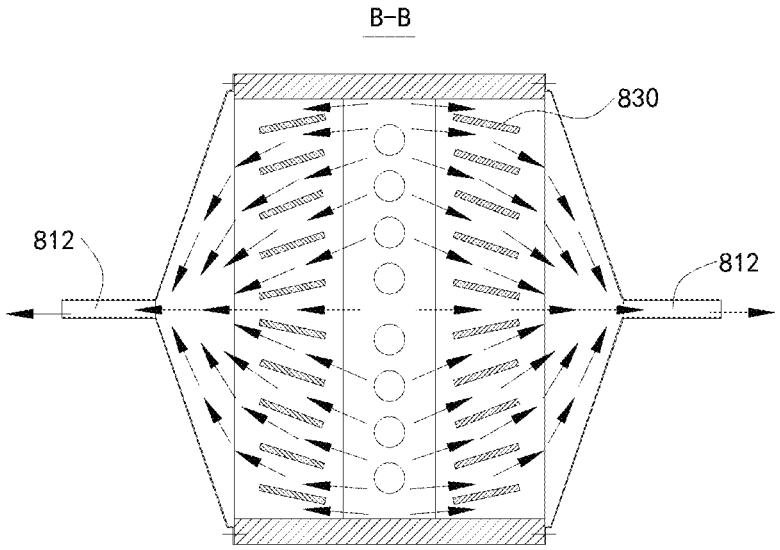
FIG. 37 is a schematic cross-sectional view taken along B-B in FIG. 33.

In some embodiments, as shown in FIG. 32 and FIG. 37, an end of the suction pipe 821 forms a suction port 812 on the suction body 810, and the suction port 812 is led to the body channel 811. Here, an end of the suction pipe 821 refers to a section thereof close to the suction body 810. In some embodiments, the rectification heating plates 830 are arranged vertically, and a plurality of rectification heating plates 830 are arranged at an interval. A plurality of rectifying channels are formed among the rectification heating plates 830, and between the rectification heating plates 830 and walls of the body channel 811. An end of the rectifying channels leads to the suction port 812. Fluid flow directions indicated by several arrows in FIG. 37 are defined by the rectifying channels.

As shown in FIG. 37, a cross-section of a portion of the body channel 811 close to the suction assembly 820 is set. It should be understood that the rectifying channels may not only be enclosed by several adjacent rectification heating plates 830, but also be enclosed by the rectification heating plates 830 at outside and an inner wall of the body channel 811 of the suction body 810.

In one possible implementation, the rectification heating plate 830 is embedded with an electric heating wire therein, and may be disposed in the form of an aluminum plate. The electric heating wire is equipped with an electrical control box to control a time and power of using, which is conducive to saving energy to a certain extent. A plate member of the rectification heating plate 830 may be provided as the above-mentioned aluminum plate, or may be made of copper material and so on by taking a thermal conductivity into consideration.

In some embodiments, as shown in FIG. 32 to FIG. 35, the suction pipe 821 includes a first straight pipe section 821*a*, a second inclined pipe section 821*b*, a third straight pipe section 821*c*, a fourth inclined pipe section 821*d* and a fifth straight pipe section 821*e* which are connected in sequence. The first straight pipe section 821*a* is fixedly connected to the suction body 810. The heating coil 824 is disposed at the first straight pipe section 821*a*. The vacuum pump 822 is mounted at another end of the fifth straight pipe section 821*e*. The suction pipe 821 also includes an exhaust pipe 821*f* mounted at another end of the vacuum pump 822. An end of the compressed air pipe 823 is disposed with a nozzle 823*a*. The nozzle 823*a* is disposed within the suction pipe 821 and at a junction of the second inclined pipe section 821*b* and the third straight pipe section 821*c*, and has an opening disposed toward the third straight pipe section 821*c*, so as to form a primary negative pressure zone 821*c* in the third straight pipe section 821*cc*. An inner diameter of the third straight pipe section 821*c* is smaller than an inner diameter of the fifth straight pipe section 821*e*, so as to form a secondary negative pressure zone 821*dd* in the fourth inclined pipe section 821*d*. An inner diameter of the third straight pipe section 821*c* is smaller than an inner diameter of the first straight pipe section 821*a*.

Figure 35:
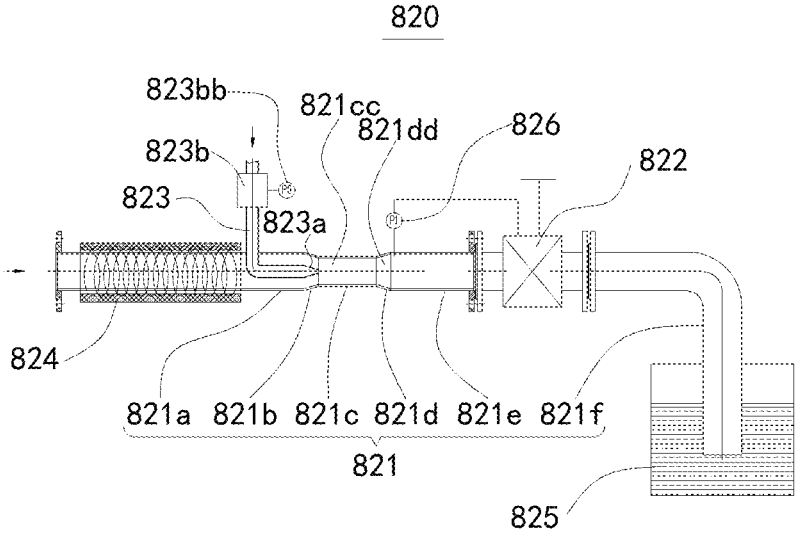
FIG. 35 is a specific structural schematic diagram of a suction assembly of the monomer suction mechanism in FIG. 33.

As shown in FIG. 35, with the above arranged the nozzle 823*a* of the compressed air pipe 823 in combination with the suction pipe 821, the primary negative pressure zone 821*cc* is formed in the third straight pipe section 821*c*. The secondary negative pressure zone 821*dd* is formed through changes of the pipe diameters of the third straight pipe section 821*c*, the fourth inclined pipe section 821*d* to the fifth straight pipe section 821*e*, and an expansion of the pipe diameter of the fourth inclined pipe section 821*d*. The primary negative pressure zone 821*cc* and the secondary negative pressure zone 821*dd* cooperate to perform a vacuum suction on the hot air containing the monomer in the body channel 811.

In some embodiments, as shown in FIG. 33 and FIG. 35, the suction pipe 821 is fixedly disposed at the suction body 810; an end of the suction pipe 821 is communicated to the body channel 811, and another end of the suction pipe 821 extends into a hot water box 825 so that a polymer of monomer within a monomer gas is dissolved with water, thereby ameliorating a situation that the monomer escapes into the air and easily causes environmental pollution and is detrimental to the health of workers.

In some embodiments, as shown in FIG. 35, the compressed air pipe 823 is disposed with an air pressure regulating valve 823*b*. The air pressure regulating valve 823*b* is configured with a first pressure gauge 823*bb*. A vacuum degree of an outlet of the nozzle 823*a* of the compressed air pipe 823 can be adjusted through the air pressure regulating valve 823*b*, and is assistedly displayed by the first pressure gauge 823*bb*.

In some embodiments, the suction pipe 821 may include a second pressure gauge 826. The second pressure gauge 826 is mounted at the fifth straight pipe section 821*e* to detect a pressure after the secondary negative pressure zone 821*dd*. The second pressure gauge 826 is also connected to the vacuum pump 822. A pressure of the secondary negative pressure zone 821*dd* is displayed through the second pressure gauge 826 to assist in controlling an extraction speed of the vacuum pump 822.

Embodiment Eight

Based on the combined spinning-drawing-winding machine for industrial bio-based polyamide and the heat-retarder 700 disclosed in Embodiment Two, Embodiment Four, Embodiment Five, Embodiment Six or Embodiment Seven, in some embodiments, the heat-retarder 700 is used in conjunction with the monomer suction mechanism 800 of the Embodiment Seven, which is an optional embodiment of the heat-retarder 700 that injects the superheated steam to the spinneret of the spinning assembly 600.

Figure 36:
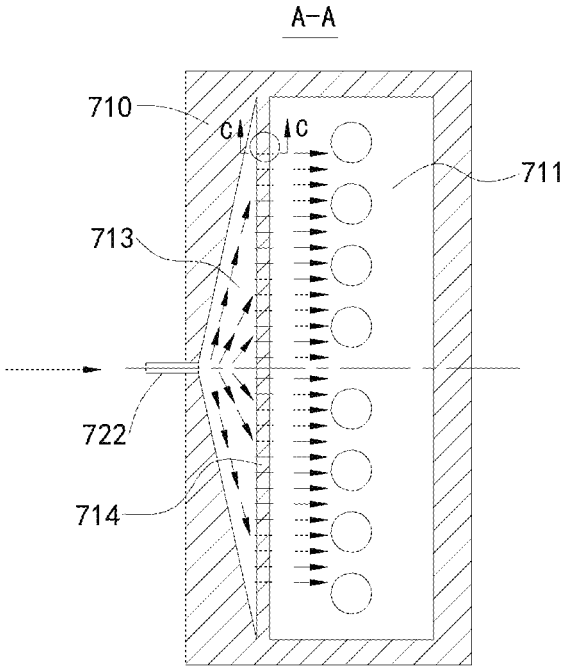
FIG. 36 is a schematic cross-sectional view taken along A-A in FIG. 33.

Referring to FIG. 33, FIG. 34 and FIG. 36, the heat-retarder 700 includes a slow-cooling and heat-uniform body 710 and a steam pipe 720. The slow-cooling and heat-uniformity body 710 is disposed with a slow cooling tow chamber 711. An upper side of the slow cooling tow chamber 711 leads to a position of the spinneret, and a lower side of the slow cooling tow chamber 711 leads to the body channel 811. A slow cooling heater (not shown in the drawings) is provided in the slow-cooling and heat-uniform body 710. The slow-cooling and heat-uniform body 710 includes an injection chamber 713 with a decreasing width. A position with the maximum width of the injection chamber 713 is connected to the slow cooling tow chamber 711 through a partition 714. The partition 714 is disposed with several injection holes 714*a* toward the slow cooling tow chamber 711. The steam pipe 720 is disposed with a pressure reducing valve 721. An end of the steam pipe 720 is configured to introduce a steam therein, and the steam is configured to form the superheated steam after passing through the pressure reducing valve 721 and the slow cooling heater. Another end of the steam pipe 720 forms a superheated-steam inlet pipe 722 at the slow-cooling and heat-uniform body 710. The superheated steam inlet pipe 722 is in communication with a position with the minimum width of the injection chamber 713.

In some embodiments, after a steam is decompressed by the pressure reducing valve 721, in some embodiments to 0.005-0.01 Mpa, and then a temperature of the steam reaches a state of superheated steam through the slow cooling heater, and the steam is injected through the injection chamber 713, the injection holes 714*a* toward a lower side of the spinneret. The steam after decompression is more easily to reach the state of superheated steam.

An arrangement of the injection chamber 713 with decreasing width as shown in FIG. 36 is conducive to a thorough mixing of the superheated steam, a gaseous monomers and oligomers.

Figure 38:
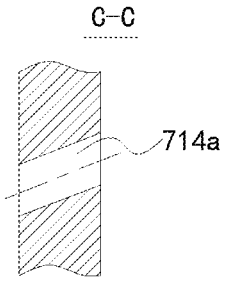
FIG. 38 is a schematic cross-sectional view taken along C-C in FIG. 36.

In some embodiments, as shown in FIG. 36 and FIG. 38, the partition 714 is disposed with several injection holes 714*a* toward the spinneret, and the superheated steam is directly injected to the spinneret through the injection holes 714*a* to fully avoid the monomer and the oligomers from adhering to a surface of the spinneret.

In some embodiments, the slow-cooling and heat-uniform body 710 is fixedly disposed on the suction body 810 to form an integrated effect of the heat-retarder 700 and the monomer suction mechanism 800. In a whole device, the heat-retarder 700 and the monomer suction mechanism 800 are configure as an integral mechanism to facilitate assembly, maintenance, volume reduction, and ensure a processing effect of the monomer.

Embodiment Nine

Figure 44:
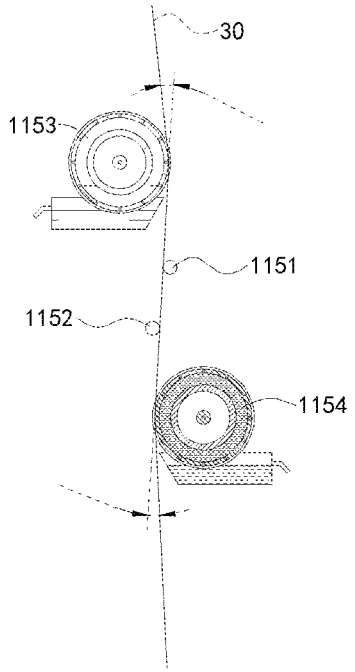
FIG. 44 is a schematic diagram of a trend of the tow passing through the pair of oil wheels in FIG. 39.
Figure 45:
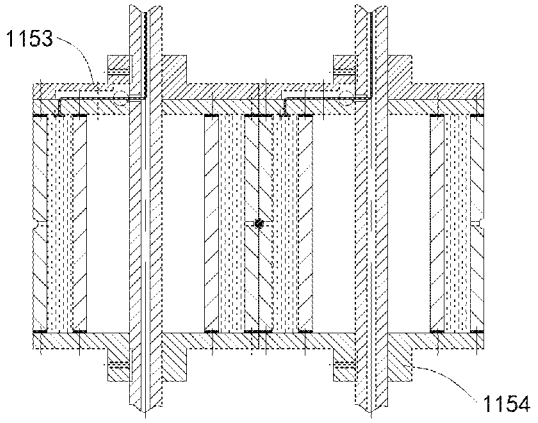
FIG. 45 is a schematic view of a structure shown in FIG. 44 from a top-down perspective.

The combined spinning-drawing-winding machine for industrial bio-based polyamide disclosed in Embodiment Two, Embodiment Four, Embodiment Five, Embodiment Six, Embodiment Seven or Embodiment Eight involves a double-surface oiling mechanism 1100. Referring to FIG. 44. This embodiment provides a double-surface oiling mechanism 1100, which includes a pair of oil wheels located on both sides of the tow 30, and the pair of oil wheels are disposed up and down and in a staggered distribution. Referring to FIG. 45 which shows the staggered distribution of the pair of oil wheels, a graphics of an upper oil wheel 1153 partially overlaps with that of a lower oil wheel 1154 in FIG. 45.

Figure 39:
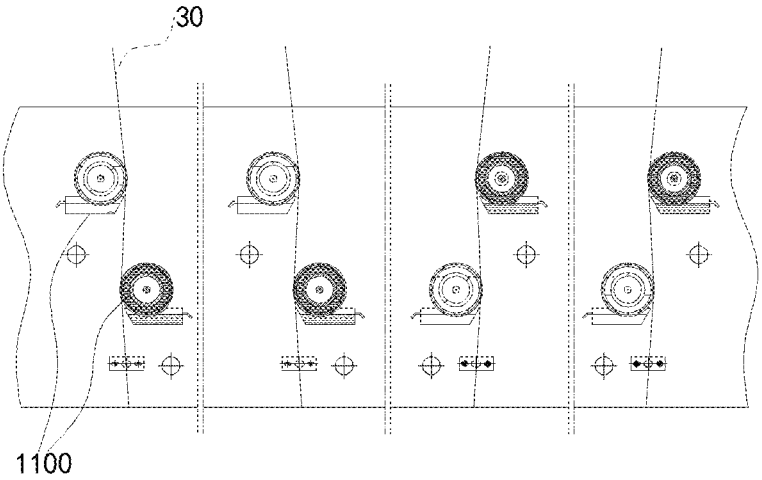
FIG. 39 is a structural schematic diagram of a double-surface oiling mechanism in FIG. 2.
Figure 40:
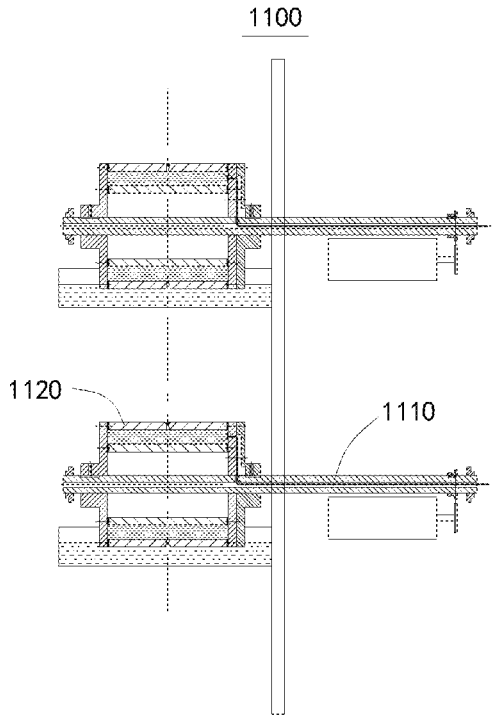
FIG. 40 is a schematic diagram of a pair of oil wheels in FIG. 39.

In some embodiments, referring to FIG. 39 and FIG. 44, the double-surface oiling mechanism 1100 may be disposed with a plurality of pairs of oil wheels, and transmission shafts 1110 of the oil wheels each are mounted at the same panel. It should be understood that the transmission shafts are rotatably mounted at the panel and are equipped with bearings for mounting. As shown in FIG. 40, the transmission shafts also pass through the panel.

Referring to FIG. 39 to FIG. 43, in the double-surface oiling mechanism 1100, the oil wheel includes the transmission shaft 1110, an oil wheel shell 1120 and an oil supply capillary 1130. The oil wheel shell 1120 and the transmission shaft 1110 are coaxially fixed. An outer periphery of the oil wheel shell 1120 is disposed with oil wheel surface grooves 1125*a* circumferentially arranged. The oil wheel shell 1120 is disposed with an oil wheel storage cavity 1126 therein. The oil wheel shell 1120 is disposed with several oil outlets 1125*b* arranged at an interval along a circumferential direction. An end of the oil outlet hole 1125*b* leads to the oil wheel storage cavity 1126, and another end of the oil outlet hole 1125*b* leads to the oil wheel surface groove 1125*a*. The oil wheel surface groove 1125*a* is configured to be in movable contact with the tow 30. An end of the oil supply capillary 1130 is in communication with the oil wheel storage cavity 1126 to supply an oil to the oil wheel.

Figure 43:
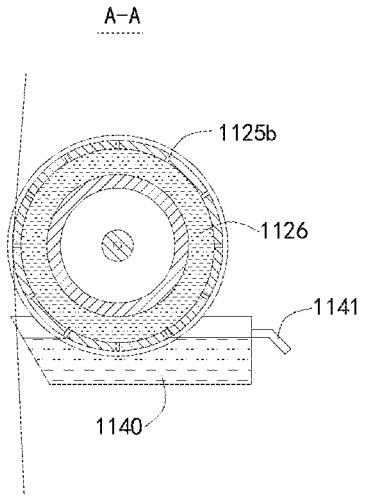
FIG. 43 is a schematic cross-sectional view taken along A-A in FIG. 41.

As shown in FIG. 43, there are shown 12 oil outlets 1125*b* arranged circumferentially at an interval. In some embodiments, the oil outlets 1125*b* are arranged along a radial direction of the oil wheel shell 1120. In some embodiments, the number of the oil outlets may be controlled as between 4-16.

The above-mentioned double-surface oiling mechanism 1100 oils the tow 30 on two sides through the pair of oil wheels located on both sides of the tow 30, and the pair of oil wheels are disposed up and down and in the staggered distribution to achieve a good oiling effect. In some embodiments, the oil wheel surface grooves 1125*a* at an outer edge of the oil wheel shell 1120 may also be adopted to oil the tow. The oil wheel shell 1120 and the transmission shaft 1110 are fixed relative to one another and have coincide axes. The transmission shaft 1110 is driven to rotate so as to drive the oil wheel shell 1120 to rotate, and an oil agent in the oil wheel storage cavity 1126 flows out via the oil hole 1125*b* to the oil wheel surface grooves 1125*a*. In a situation that the oil wheel surface grooves 1125*a* and each pair of oil wheels are distributed up and down and in a staggered distribution, the tow 30 is in close contact with a surface of the oil wheel with a long contact distance, so that the tow 30 is evenly oiled. Therefore, the oil agent can be sprayed evenly on a surface of the bio-based polyamide fiber to the maximum extent, and a rotation speed of the transmission shaft 1110 can also be controlled to control a moisture content and an oil content of the tow 30 after oiled.

Correspondingly, a speed of a motor may be adjusted through a frequency converter to control the rotation speed of the oil wheel, thereby achieving a purpose of controlling oiling. The rotation speed of the oil wheels for the bio-based polyamide fiber is generally controlled within 12 to 32 rpm.

Figure 41:
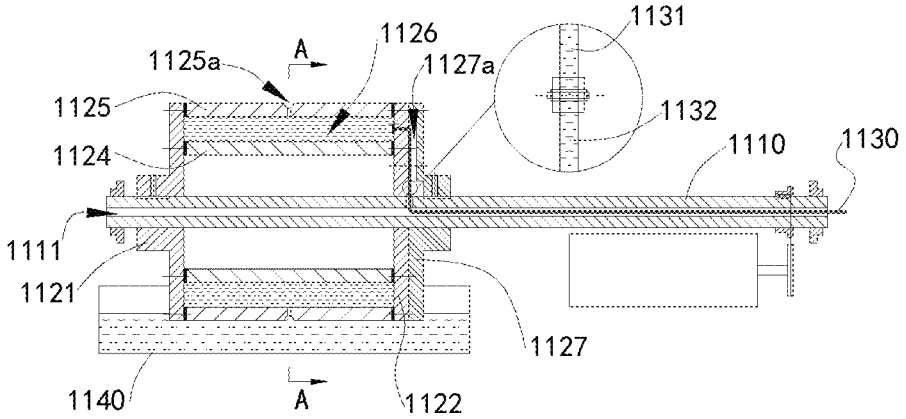
FIG. 41 is a specific structural schematic diagram of the oil wheel in FIG. 40.
Figure 42:
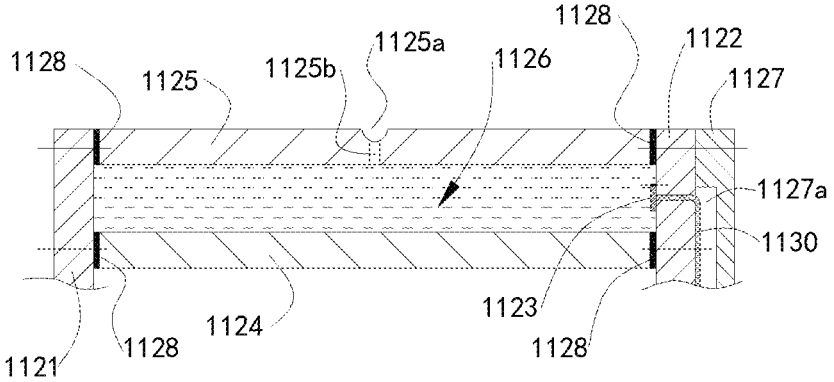
FIG. 42 is a partial structural schematic diagram of the oil wheel in FIG. 41.

In some embodiments, referring to FIG. 41 and FIG. 42, the oil wheel shell 1120 includes a left end cover 1121, a first right end cover 1122, an oil wheel inner shell 1124 and an oil wheel outer shell 1125. The left end cover 1121 is fixedly connected to the transmission shaft 1110. The first right end cover 1122 is relatively fixed to the transmission shaft 1110. In some embodiments, the first right end cover 1122 is directly fixedly connected to the transmission shaft 1110. The first right end cover 1122 is spaced apart from the left end cover 1121. A one-way check plate 1123 is provided on a side of the first right end cover 1122 close to the left end cover 1121. The oil supply capillary 1130 passes through the first right end cover 1122 to connect to the one-way check plate 1123. When an oil agent pump continuously supplies the oil agent, a pressure of the oil agent pushes the one-way check plate 1123 to be turned on. The oil wheel inner shell 1124 is disposed in a cylindrical shape and is fixed between the left end cover 1121 and the first right end cover 1122. The oil wheel outer shell 1125 is disposed in a cylindrical shape and is fixed between the left end cover 1121 and the first right end cover 1122. The oil wheel outer shell 1125 is arranged outside the oil wheel inner shell 1124. The oil wheel outer shell 1125, the oil wheel inner shell 1124, the left end cover 1121, and the first right end cover 1122 are enclosed together to form an oil wheel storage cavity 1126. The oil wheel surface groove 1125*a* is disposed at the outer edge of the oil wheel outer shell 1125, and the oil outlet hole 1125*b* runs through the oil wheel outer shell 1125.

The above-mentioned oil wheel inner shell 1124 and oil wheel outer shell 1125 may be made of seamless steel pipes, and transmission shaft 1110 may similarly also be made of the seamless steel pipes. A fixed connection between the left end cover 1121 and the transmission shaft 1110, a fixed connection between the left end cover 1121 and the oil wheel outer shell 1125, a fixed connection between the left end cover 1121 and the oil wheel inner shell 1124, a relative fixation between the first right end cover 1122 and the transmission shaft 1110, a fixed connection between the first right end cover 1122 and the oil wheel outer shell 1125 and a fixed connection between the first right end cover 1122 and the oil wheel inner shell 1124 may each adopt a way of screw connection. In other possible embodiments, a welding and so on may also be adopted. In the way of screw connection, internal threads may be tapped at both axial ends of the oil wheel inner shell 1124 and both axial ends of the oil wheel outer shell 1125 respectively.

The above-mentioned oil supply capillary 1130 passes through the one-way check plate 1123 and then is in communication with the oil wheel storage cavity 1126. The one-way check plate 1123 plays a role in defining a single flow direction, which is beneficial to stable oiling. An end of the oil supply capillary 1130 away from the oil wheel storage cavity 1126 may be connected to a hose with a looper clamp. The hose is connected to the oil agent pump. The oil agent pump generates a pressure to supply oil, and the oil agent enters the oil supply capillary 1130 through the hose. The oil agent pushes the one-way check plate 1123 into the oil wheel storage cavity 1126. An amount of the oil agent in the oil wheel storage cavity 1126 is determined by a supply volume of the oil agent pump.

In some embodiments, referring to FIG. 41 and FIG. 42, the oil wheel shell 1120 also includes a second right end cover 1127. The second right end cover 1127 is disposed at an side of the first right end cover 1122 away from the left end cover 1121. The second right end cover 1127 is fixedly connected to the first right end cover 1122 and the transmission shaft 1110 respectively. The second right end cover 1127 and the first right end cover 1122 are enclosed to form a chamber 1127*a* for the oil supply capillary 1130 to penetrate into.

In some embodiments, the first right end cover 1122 is fixedly connected to the second right end cover 1127, and the second right end cover 1127 is fixedly connected to the transmission shaft 1110, so that the first right end cover 1122 and the transmission shaft 1110 are relatively fixed. In this way, since the second right end cover 1127 is fixedly connected to the transmission shaft 1110, the first right end cover 1122 is no longer directly fixed on the transmission shaft 1110 to facilitate an installation and reduce an installation difficulty. In this embodiment, if the fixed connection is achieved by screws, the first right end cover 1122 may be fixed with the second right end cover 1127 by screws, and the second right end cover 1127 may be fixed with the transmission shaft 1110 by screws as shown in FIG. 41. A portion of the oil supply capillary 1130 exposed from the first right end cover 1122 is covered by the disposed second right end cover 1127.

In some embodiments, the oil supply capillary 1130 is partially penetrated into a through hole 1111 arranged along an axis of the transmission shaft 1110 to facilitate an implementation of a technical solution that the oil supply capillary 1130 rotates with the transmission shaft 1110.

In some embodiments, referring to FIG. 41 and FIG. 42, the oil supply capillary 1130 includes a first L-shaped capillary 1131 and a second L-shaped capillary 1132. An end of the first L-shaped capillary 1131 is in communication with the one-way check plate 1123. Another end of an L-shaped capillary 1131 and an end of the second L-shaped capillary 1132 are fixedly connected to a chamber 1127*a* enclosed by the second right end cover 1127 and the first right end cover 1122. The second L-shaped capillary 1132 is partially penetrated into a through hole 1111 arranged along an axis of the transmission shaft 1110. A partially enlarged view in FIG. 41 shows a connection of the first L-shaped capillary 1131 with the second L-shaped capillary 1132. Regarding a connection of the first L-shaped capillary 1131 with the second L-shaped capillary 1132, the two capillaries may be integrated through ways such as clamping and high-temperature melting and so on. The oil supply capillary 1130 is assembled from two sections of L-shaped tubes, and therefore it is easy to disassemble and assemble.

In some embodiments, as shown in FIG. 42, the oil wheel shell 1120 also includes a sealing gasket 1128. The sealing gasket 1128 is provided between the oil wheel inner shell 1124 and the left end cover 1121, between the oil wheel inner shell 1124 and the first right end cover 1122, between the oil wheel outer shell 1125 and the left end cover 1121, and between the oil wheel outer shell 1125 and the first right end cover 1122. A sealing performance of the oil wheel storage cavity 1126 is improved through the sealing gasket 1128.

In some embodiments, referring to FIG. 41 and FIG. 43, the oil wheel also includes an oil receiving box 1140, which is fixedly provided below the oil wheel shell 1120, and also provided with an overflow hole 1141. The overflow hole 1141 can be in the form of an overflow pipe, and an overflow opening of the overflow pipe is higher than a bottom side of the oil receiving box 1140. An oil fluid is collected through the oil receiving box 1140 and discharged from the overflow hole 1141 for gathering. In some embodiments, when oiling, the oil wheel shell 1120 rotates and the oil receiving box 1140 is stationary. The oil collected in the oil receiving box 1140 can still continue to oil the filament.

In some embodiments, the transmission shaft 1110 is driven by a motor through a way of coupler, gear transmission, chain transmission and so on. When a chain drive is adopted, there are sprockets and chains involved. It can be understood that the transmission shaft 1110 is equipped with the bearings.

In some embodiments, as shown in FIG. 44, for each pair of oil wheels, a first tension rod 1151 and a second tension rod 1152 respectively located on both sides of the tow 30 are also configured. The first tension rod 1151 and the second tension rods 1152 each are in a movable contact with the tow 30. A pair of oil wheels includes an upper oil wheel 1153 and a lower oil wheel 1154. The upper oil wheel 1153, the first tension rod 1151, the second tension rod 1152 and the lower oil wheel 1154 are arranged in sequence along a height direction. The upper oil wheel 1153 and the second tension rod 1152 are located on a same side of the tow 30, and the lower oil wheel 1154 and the first tension rod 1151 are located on another side of the tow 30.

Through the double-surface oiling mechanism 1100 of this embodiment, it is conducive to oiling the industrial bio-based polyamide filament of 55 dtex-2222 dtex. When the spinning speed is low, a contact range between the tow 30 and a surface of the oil wheel is larger, and an oil film formed on the surface of the oil wheel is stable, and a uniform oil film can be obtained on the tow 30 to meet a subsequent large-scale thermal drawing process.

The above-mentioned embodiments are preferred embodiments of the disclosure which are only used to facilitate the explanation of the disclosure and are not intended to limit the disclosure in any form. Equivalent embodiments with local changes or modifications made by any skilled in the art with common knowledge by using the technical content disclosed in the disclosure which are within the scope of the technical features mentioned in the disclosure and does not depart from the content of the technical features of the disclosure, will still fall within the scope of the technical features of the disclosure.

What is claimed is:

1. A spinning-drawing-winding device for industrial bio-based polyamide, sequentially comprising, along a traveling direction of a tow, a feeding-splitting filament tension roller, a first pair of drawing hot rollers, a second pair of drawing hot rollers, a third pair of drawing hot rollers, a fourth pair of drawing hot rollers and a fifth pair of drawing hot rollers;

two adjacent rotational directions among a rotational direction of the tow winding through the first pair of drawing hot rollers, a rotational direction of the tow winding through the second pair of drawing hot rollers, a rotational direction of the tow winding through the third pair of drawing hot rollers, a rotational direction of the tow winding through the fourth pair of drawing hot rollers are opposite to each other to spin an industrial bio-based polyamide filament of 55 dtex-2222 dtex, wherein along the direction of traveling of the tow, the device sequentially comprises the feeding-splitting filament tension roller, a first heating plate, the first pair of drawing hot rollers, a second heating plate, the second pair of drawing hot rollers, a third heating plate, the third pair of drawing hot rollers, a fourth heating plate, the fourth pair of drawing hot rollers, a fifth heating plate and the fifth pair of drawing hot rollers;

the first heating plate, the second heating plate, the third heating plate, the fourth heating plate and the fifth heating plate each heat the tow in areas between two adjacent rollers;

wherein when the tow travels from the feeding-splitting filament tension roller to the first pair of drawing hot rollers, the rotational direction of the tow winding through the feeding-splitting filament tension roller is the counterclockwise direction, and the rotational direction of the tow winding through the first pair of drawing hot rollers is the counterclockwise direction, and thus the feeding-splitting filament tension roller directly contacts and heats a N surface of the tow, and the first pair of drawing hot rollers directly contact and heat the N surface of the tow; and wherein the rotational direction of the tow winding through the second pair of drawing hot rollers is the clockwise direction, and the second pair of drawing hot rollers directly contact and heat a M surface of the tow; and wherein the rotational direction of the tow winding through the third pair of drawing hot rollers is the counterclockwise direction, and the third pair of drawing hot rollers directly contact and heat the N surface of the tow; and wherein the rotational direction of the tow winding through the fourth pair of drawing hot rollers is the clockwise direction, and the fourth pair of drawing hot rollers directly contact and heat the M surface of the tow; and thus the N surface of the tow, the M surface of the tow are sequentially contacted and heated respectively by the first pair of drawing hot rollers up to the fourth pair of drawing hot rollers.

2. The spinning-drawing-winding device for industrial bio-based polyamide according to claim 1, wherein:

the feeding-splitting filament tension roller adopts a fixed cold roller cooperating with an angle-adjustable splitting filament roller; and the first pair of drawing hot rollers, the second pair of drawing hot rollers, the third pair of drawing hot rollers, the fourth pair of drawing hot rollers and the fifth pair of drawing hot rollers each adopt an angle-adjustable hot roller cooperating with an angle-adjustable hot roller;

the first pair of drawing hot rollers are low-temperature rollers; the second pair of drawing hot rollers, the third pair of drawing hot rollers, the fourth pair of drawing hot rollers and the fifth pair of drawing hot rollers each are high temperature rollers; and a draw ratio between the feeding-splitting filament tension roller and the first pair of drawing hot rollers is maintained at 1:(1.04-1.08); a draw multiple of the first pair of drawing hot rollers and the second pair of drawing hot rollers is 1.5 to 3.5 times; a draw multiple of the second pair of drawing hot rollers and the third pair of drawing hot rollers is 2.0 to 3.5 times; a draw multiple of the third pair of drawing hot rollers and the fourth pair of drawing hot rollers is generally 1.7 to 2.5 times; and a draw multiple of the fourth pair of drawing hot rollers and the fifth pair of drawing hot rollers is 0.9-1.0 times.

3. The spinning-drawing-winding device for industrial bio-based polyamide according to claim 1, wherein:

when an industrial bio-based polyamide filament of 55 dtex-111 dtex is spun, a heating temperature of the first heating plate is set as 50-65° C., and a temperature of the first pair of drawing hot rollers is set as 75-100° C.; and when an industrial bio-based polyamide filament of 1670 dtex-2222 dtex is spun, a heating temperature of the first heating plate is set as 70-90° C., and a temperature of the first pair of drawing hot rollers is set as 75-100° C.

4. The spinning-drawing-winding device for industrial bio-based polyamide according to claim 1, wherein a heating temperature of the second heating plate is set as 95-115° C., and a temperature of the second pair of drawing hot roller is set as 110-145° C.

5. The spinning-drawing-winding device for industrial bio-based polyamide according to claim 1, wherein a heating temperature of the third heating plate is set as 110-155° C., and a temperature of the third pair of drawing hot rollers is set as 130-150° C.

6. The spinning-drawing-winding device for industrial bio-based polyamide according to claim 1, wherein a heating temperature of the fourth heating plate is set as 125-195° C., and a temperature of the fourth pair of drawing hot rollers is set as 130-150° C.

7. The spinning-drawing-winding device for industrial bio-based polyamide according to claim 1, wherein a heating temperature of the fifth heating plate is set as 140-220° C., and a temperature of the fifth pair of drawing hot rollers is set as 130-210° C.

8. The spinning-drawing-winding device for industrial bio-based polyamide according to claim 3, wherein:

a heating temperature of the second heating plate is set as 95-115° C., and a temperature of the second pair of drawing hot roller is set as 110-145° C.;

a heating temperature of the third heating plate is set as 110-155° C., and a temperature of the third pair of drawing hot rollers is set as 130-150° C.;

a heating temperature of the fourth heating plate is set as 125-195° C., and a temperature of the fourth pair of drawing hot rollers is set as 130-150° C.; and a heating temperature of the fifth heating plate is set as 140-220° C., and a temperature of the fifth pair of drawing hot rollers is set as 130-210° C.

9. The spinning-drawing-winding device for industrial bio-based polyamide according to claim 1, wherein the first heating plate, the second heating plate, the third heating plate, the fourth heating plate, and the fifth heating plate each comprise a heat transfer block and a plurality of heating rods; the heat transfer block is disposed with an opening slot for the tow to pass through; the plurality of heating rods are arranged sequentially along a length direction of the opening slot; the heating rods each are arranged in a shape of hook which is formed with a hook portion and a hook groove; the hook portion is disposed within the heat transfer block; and the hook groove is for the tow to pass through.

10. A combined spinning-drawing-winding machine for industrial bio-based polyamide, comprising the following disposed in sequence according to a production process: a screw extruder, a melt pipe, a spinning box, a metering pump, a spinning assembly, a heat-retarder, a monomer suction mechanism, a side blowing component, a spinning channel component, a double-surface oiling mechanism, a pre-interlacer, a filament guider, a feeding-splitting filament tension roller, a first heating plate, a first pair of drawing hot rollers, a second heating plate, a second pair of drawing hot rollers, a third heating plate, a third pair of drawing hot rollers, a fourth heating plate, a fourth pair of drawing hot rollers, a fifth heating plate, a fifth pair of drawing hot rollers, a final interlacer and a fully automatic winding head;

the first heating plate, the second heating plate, the third heating plate, the fourth heating plate and the fifth heating plate each heat the tow in areas between two adjacent rollers; and two adjacent rotational directions among a rotational direction of the tow winding through the first pair of drawing hot rollers, a rotational direction of the tow winding through the second pair of drawing hot rollers, a rotational direction of the tow winding through the third pair of drawing hot rollers, a rotational direction of the tow winding through the fourth pair of drawing hot rollers are opposite to each other to spin an industrial bio-based polyamide filament of 55 dtex-2222 dtex;

wherein when the tow travels from the feeding-splitting filament tension roller to the first pair of drawing hot rollers, the rotational direction of the tow winding through the feeding-splitting filament tension roller is the counterclockwise direction, and the rotational direction of the tow winding through the first pair of drawing hot rollers is the counterclockwise direction, and thus the feeding-splitting filament tension roller directly contacts and heats a N surface of the tow, and the first pair of drawing hot rollers directly contact and heat the N surface of the tow; and wherein the rotational direction of the tow winding through the second pair of drawing hot rollers is the clockwise direction, and the second pair of drawing hot rollers directly contact and heat a M surface of the tow; and wherein the rotational direction of the tow winding through the third pair of drawing hot rollers is the counterclockwise direction, and the third pair of drawing hot rollers directly contact and heat the N surface of the tow; and wherein the rotational direction of the tow winding through the fourth pair of drawing hot rollers is the clockwise direction, and the fourth pair of drawing hot rollers directly contact and heat the M surface of the tow; and thus the N surface of the tow, the M surface of the tow are sequentially contacted and heated respectively by the first pair of drawing hot rollers up to the fourth pair of drawing hot rollers.

11. The combined spinning-drawing-winding machine for industrial bio-based polyamide according to claim 10, wherein the feeding-splitting filament tension roller adopts a fixed cold roller cooperating with an angle-adjustable splitting filament roller; and the first pair of drawing hot rollers, the second pair of drawing hot rollers, the third pair of drawing hot rollers, the fourth pair of drawing hot rollers and the fifth pair of drawing hot rollers each adopt an angle-adjustable hot roller cooperating with an angle-adjustable hot roller;

the first pair of drawing hot rollers are low-temperature rollers, and the second pair of drawing hot rollers, the third pair of drawing hot rollers, the fourth pair of drawing hot rollers and the fifth pair of drawing hot rollers each are high temperature rollers; and a draw ratio between the feeding-splitting filament tension roller and the first pair of drawing hot rollers is maintained at 1:(1.04-1.08); a draw multiple of the first pair of drawing hot rollers and the second pair of drawing hot rollers is 1.5 to 3.5 times; a draw multiple of the second pair of drawing hot rollers and the third pair of drawing hot rollers is 2.0 to 3.5 times; a draw multiple of the third pair of drawing hot rollers and the fourth pair of drawing hot rollers is generally 1.7 to 2.5 times; and a draw multiple of the fourth pair of drawing hot rollers and the fifth pair of drawing hot rollers is 0.9-1.0 times.

12. The combined spinning-drawing-winding machine for industrial bio-based polyamide according to claim 11, wherein when an industrial bio-based polyamide filament of 55 dtex-111 dtex is spun, a heating temperature of the first heating plate is set as 50-65° C., and a temperature of the first pair of drawing hot rollers is set as 75-100° C.; when an industrial bio-based polyamide filament of 1670 dtex-2222 dtex is spun, a heating temperature of the first heating plate is set as 70-90° C., and a temperature of the first pair of drawing hot rollers is set as 75-100° C.;

a heating temperature of the second heating plate is set as 95-115° C., and a temperature of the second pair of drawing hot roller is set as 110-145° C.;

a heating temperature of the third heating plate is set as 110-155° C., and a temperature of the third pair of drawing hot rollers is set as 130-150° C.;

a heating temperature of the fourth heating plate is set as 125-195° C., and a temperature of the fourth pair of drawing hot rollers is set as 130-150° C.; and a heating temperature of the fifth heating plate is set as 140-220° C., and a temperature of the fifth pair of drawing hot rollers is set as 130-210° C.

13. The combined spinning-drawing-winding machine for industrial bio-based polyamide according to claim 10, wherein the screw extruder is disposed with an extruder screw therein; the extruder screw comprise a screw feed section, a screw compression section and a screw metering section, and wherein an end of the screw feed section is detachably connected to an end of the screw compression section, and another end of the screw compression section is detachably connected to an end of the screw metering section;

the screw extruder is equipped with an extrusion head, and wherein the extrusion head comprises a pressure sensor for detecting a pressure value of a melt, and is disposed with a pre-filter ring in a melt channel of the extrusion head.

14. The combined spinning-drawing-winding machine for industrial bio-based polyamide according to claim 10, wherein the melt pipe comprises:

a melt main pipe with an end connected to the screw extruder;

a plurality of melt branch pipes, an end of each of which is in communication with another end of the melt main pipe, and each of further ends of which is connected to the plurality of spinning boxes in one-to-one relationship;

a plurality of delivery pumps, mounted at the plurality of melt branch pipes in one-to-one relationship;

a pressure-measuring element for melt in melt pipe, mounted in the melt main pipe; and the spinning boxes each are equipped with a pressure-measuring element for melt in spinning-box, and the pressure-measuring element for melt in melt pipe and the pressure-measuring element for melt in spinning-box are both connected to an electrical frequency converter for assisting the electrical frequency converter to control the delivery pumps.

15. The combined spinning-drawing-winding machine for industrial bio-based polyamide according to claim 14, wherein the melt pipe comprises:

a melt-pipe heater assembly, mounted at the melt main pipe and the melt branch pipe; and a plurality of melt-pipe temperature measuring elements, mounted at the plurality of melt branch pipes in one-to-one relationship to detect a temperature of the melt flowing through the melt branch pipe; and wherein the melt pipe heater assembly comprises:

a plurality of melt-pipe electrical heaters, surrounding the melt main pipe and the melt branch pipe; and a melt-pipe metal filler, disposed between the melt-pipe electrical heater and a cavity wall of a melt pipe cavity of the melt main pipe, and between the melt-pipe electrical heater and a cavity wall of a melt-pipe cavity of the melt branch pipe.

16. The combined spinning-drawing-winding machine for industrial bio-based polyamide according to claim 10, wherein the spinning box comprises:

an upper box;

a lower box, fixedly connected to the upper box;

a metering pump and a detachable pump base, the metering pump mounted at the detachable pump base, and the metering pump and the detachable pump base both disposed within the upper box;

a spinning assembly, disposed within the lower box;

a box pipe, used for communicating the melt pipe to the detachable pump base and communicating the detachable pump base to the spinning assembly;

an upper-box heater assembly, disposed at the upper box;

a lower-box heater assembly, disposed at the lower box; and spinning-box metal fillers, respectively disposed within the upper box and the lower box.

17. The combined spinning-drawing-winding machine for industrial bio-based polyamide according to claim 10, wherein the monomer suction mechanism comprises:

a suction body, disposed with a body channel leading to the spinning assembly, wherein a heat-retarder is disposed between the monomer suction mechanism and the spinning assembly; and the heat-retarder injects a superheated steam onto the tow coming out of the spinning assembly to form a hot steam containing the monomer;

a suction assembly, comprising a suction pipe in communication with the body channel, a vacuum pump disposed at the suction pipe, a compressed air pipe with an end for introducing a compressed air, and a heating coil surrounding the suction pipe, wherein another end of the compressed air pipe extends into the suction pipe between the suction body and the vacuum pump, and the heating coil is disposed between the suction body and the compressed air pipe; and a plurality of rectification heating plates, arranged in the body channel at an interval and form a rectifying channel in the body channel that leads to the suction pipe, and wherein the hot steam containing the monomer is adsorbed to the suction pipe through the rectifying channel.

18. The combined spinning-drawing-winding machine for industrial bio-based polyamide according to claim 17, wherein the suction pipe comprises a first straight pipe section, a second inclined pipe section, a third straight pipe section, a fourth inclined pipe section and a fifth straight pipe section which are connected in sequence; the first straight pipe section is fixedly connected to the suction body; the heating coil is disposed at the first straight pipe section; the vacuum pump is mounted at another end of the fifth straight pipe section; and the suction pipe also comprises an exhaust pipe mounted at another end of the vacuum pump;

an end of the compressed air pipe is provided with a nozzle, and the nozzle is disposed within the suction pipe and at a junction of the second inclined pipe section and the third straight pipe section, and has an opening disposed toward the third straight pipe section, so as to form a primary negative pressure zone in the third straight pipe section;

an inner diameter of the third straight pipe section is smaller than an inner diameter of the fifth straight pipe section, so as to form a secondary negative pressure zone in the fourth inclined pipe section; and an inner diameter of the third straight pipe section is smaller than an inner diameter of the first straight pipe section.

19. The combined spinning-drawing-winding machine for industrial bio-based polyamide according to claim 10, wherein the double-surface oiling mechanism comprises a pair of oil wheels located on both sides of the tow, and the pair of oil wheels are disposed up and down and in a staggered distribution, and wherein the oil wheel comprises:

a transmission shaft;

an oil wheel shell, coaxially fixed to the transmission shaft, wherein an outer periphery of the oil wheel shell is disposed with oil wheel surface grooves circumferentially arranged; the oil wheel shell is disposed with an oil wheel storage cavity therein, and disposed with several oil outlets arranged at an interval along a circumferential direction; an end of the oil outlet holes leads to the oil wheel storage cavity, and another end of the oil outlet holes leads to the oil wheel surface groove; and the oil wheel surface groove is configured to be in movable contact with the tow; and an oil supply capillary, an end of which is in communication with the oil wheel storage cavity to supply an oil to the oil wheel storage cavity.

* * * * *